United States Patent [19]

Newhouse

[11] Patent Number: 4,914,873

[45] Date of Patent: Apr. 10, 1990

[54] WORK ENVIRONMENT SYSTEM

[75] Inventor: Thomas J. Newhouse, Grand Rapids, Mich.

[73] Assignee: Herman Miller, Inc., Zeeland, Mich.

[21] Appl. No.: 21,973

[22] Filed: Mar. 5, 1987

[51] Int. Cl.[4] ..... A47B 5/02; E04F 19/06

[52] U.S. Cl. ..... 52/36; 52/79.9; 52/79.12; 52/238.1; 52/239; 312/198

[58] Field of Search ..... 52/79.1, 79.2, 79.9, 52/79.12, 238.1, 243.1, 239–243, 278, 281, 282, 285, 586, 33, 36; 403/192, 194, 195, 197; 280/47.35; 211/182, 189; 312/198, 265

[56] References Cited

U.S. PATENT DOCUMENTS

| | | | |
|---|---|---|---|
| 399,266 | 3/1889 | Hull . | |
| 1,524,767 | 2/1925 | VanderVoort . | |
| 1,840,048 | 1/1932 | Michelman . | |
| 1,936,013 | 11/1933 | Goldberg . | |
| 2,117,269 | 5/1938 | Beil . | |
| 2,518,969 | 8/1950 | Woodard . | |
| 2,609,638 | 9/1952 | Lindenmeyer . | |
| 2,679,074 | 5/1954 | Bryden . | |
| 2,805,739 | 9/1957 | Dennison . | |
| 2,871,520 | 2/1959 | Ruda . | |
| 2,972,495 | 2/1961 | Yalen . | |
| 3,195,698 | 7/1965 | Codrea . | |
| 3,252,614 | 5/1966 | Evans . | |
| 3,276,797 | 10/1966 | Humes, Jr. . | |
| 3,300,250 | 1/1967 | Dollgener et al. . | |
| 3,404,501 | 10/1968 | Von Wedel . | |
| 3,418,765 | 12/1968 | Propst et al. . | |
| 3,425,171 | 2/1969 | Propst et al. . | |
| 3,430,997 | 3/1969 | Propst et al. . | |
| 3,448,551 | 6/1969 | Heller . | |
| 3,463,218 | 8/1969 | Cannon et al. . | |
| 3,545,796 | 12/1970 | Nicholls . | |
| 3,559,352 | 2/1971 | Magnuson . | |
| 3,565,152 | 2/1971 | Cohn, Jr. et al. . | |
| 3,688,419 | 9/1972 | Woolman . | |
| 3,698,565 | 10/1972 | Weber . | |
| 3,717,258 | 2/1973 | McKinnon . | |
| 3,842,555 | 10/1974 | Korell . | |
| 3,844,079 | 10/1974 | Karrip | 52/221 |
| 3,864,051 | 2/1975 | Reid . | |
| 3,884,002 | 5/1975 | Logie . | |
| 3,922,788 | 12/1975 | Rota . | |
| 3,985,083 | 10/1976 | Pofferi | 108/111 |
| 4,045,927 | 9/1977 | Diaz . | |
| 4,047,342 | 9/1977 | Boulva . | |
| 4,103,465 | 8/1978 | McDonald, Jr. . | |
| 4,129,163 | 12/1978 | Johnson . | |
| 4,228,906 | 10/1980 | Jones . | |
| 4,299,067 | 11/1981 | Bertschi | 52/127.12 |

(List continued on next page.)

FOREIGN PATENT DOCUMENTS

| | | | |
|---|---|---|---|
| 222660 | 6/1959 | Australia | 211/182 |
| 115759 | 11/1969 | Denmark | 211/182 |
| 2488117 | 2/1982 | France | 211/189 |
| 384183 | 1/1965 | Switzerland | 52/584 |
| 1135761 | 12/1968 | United Kingdom | 211/182 |
| 8604372 | 7/1986 | World Int. Prop. O. | 52/239 |

*Primary Examiner*—James L. Ridgill, Jr.

*Attorney, Agent, or Firm*—Varnum, Riddering, Schmidt & Howlett

[57] ABSTRACT

A work environment system, for product assembly, repair, storage and packaging, comprises a plurality of freestanding rigid rectangular frame modules (32) formed of vertical frame members (36) and upper and lower horizontal frame members (38, 40). The modules (32) can be securely connected together in end-to-end relationship at a number of angles by connectors (100) to form work stations (10,12,14,16,20,22) of various size and geometric configuration. The work stations (30) can be equipped with a variety of functional components to be utilized in product assembly, repair, storage and packaging, such functional components including work surfaces (242), shelves (244) and storage cabinets (246), all of which are connected to the freestanding modules (32). The work environment system further includes various transport carts (446) for transporting products and tools between work stations and which can be assembled substantially from the vertical and horizontal frame members (36,38,40) of the modules (32).

35 Claims, 19 Drawing Sheets

U.S. PATENT DOCUMENTS 4,308,802 1/1982 Munz ..... 108/156
4,312,558 1/1982 Duerr et al. ..... 339/130 R
4,349,113 9/1982 Schreiner .
4,363,496 12/1982 Schreiner .
4,377,241 3/1983 Schreiner .
4,401,222 8/1983 Kulikowski et al. .
4,423,573 1/1984 Ohmholt et al. .
4,424,654 1/1984 Anderson et al. .
4,433,884 2/1984 Edwards et al. ..... 312/256
4,443,986 4/1984 Propst et al. .
4,457,117 7/1984 Leiher et al. .
4,482,063 11/1984 Berke et al. .
4,508,231 4/1985 Honickman ..... 211/199
4,512,591 4/1985 Plante ..... 280/47.35
4,571,907 2/1986 Defouw et al. ..... 52/239
4,605,988 8/1986 Nienhuis et al. ..... 361/429
4,607,754 8/1986 Wolf ..... 211/183

WORK ENVIRONMENT SYSTEM

FIELD OF THE INVENTION

The invention relates to a work environment system comprising a plurality of work stations defined by freestanding rectangular modules and a number of functional components usable at the work stations, and more specifically to a work environment system wherein the freestanding modules can be interchangeably assembled in a variety of ways to create work stations of various size and configuration.

BACKGROUND OF THE INVENTION

In modern factory and commercial environments wherein products are assembled, repaired, stored, packaged or shipped, it is desirable to utilize large open areas within a building and to provide such areas with a flexible furnishing system capable of relatively rapid change-over to accommodate changing product assembly, packaging, etc,, requirements.

It has long been conventional to construct permanent or semipermanent space-divider walls to create individual work areas and to furnish such areas with furniture of the conventional type, that is, furniture entirely or substantially entirely independent of the walls. Such arrangements are adequate under circumstances in which the requirements of the activities performed in the work areas remain relatively static over long periods of time. However, under modern factory and commercial conditions, such systems have proved to be inadequate and the source of both inconvenience and excessive cost.

Modern factory and commercial environments are characterized by product assembly, storage, packaging, etc., activities which constantly change. This phenomena results from, for example, the fact that what is considered as an appropriate working environment for a particular activity rapidly changes. In addition, the tools used in a particular activity are often modified. fied. Further, the fundamentals of the activities themselves constantly change.

The concept of using a built-in or semibuilt-in space-dividing system and conventional furniture immediately creates a problem when a change is to be made. The cost and time requirements of changing the spare divider system is often so great that the necessary and desirable changes frequently are not made. Indeed, the space-divider scheme originally erected and the furnishings within the work areas defined by the scheme are often used long after they have obtained functional obsolescence because of the cost of reorganization and replacement necessary to restore functional utility.

To overcome the problems presented in the modern work environment by the conventional furnishings heretofore described, there have been work environment systems which are capable of rapid change-over from one arrangement to another and which typically include a number of work stations defined by a plurality of freestanding walls. Such systems have been termed "modular-type"work environment systems. The freestanding walls of such work environment systems are generally detachably joined together in a number of ways to form work stations of varying size and configuration, with the freestanding walls serving as visual and audial barriers between one or more work areas within the work stations. In addition, the freestanding walls not only subdivide the work area but they also provide the means upon which work surfaces or supports are mounted. The work supports may be arranged anywhere within the work stations defined by the freestanding walls to adapt the work stations to the demands of different types of activities. The work supports, while supported by the freestanding walls, are wholly independent of the same so that work supports of a wide variety of designs are completely interchangeable and may be installed for use with any one or more of the freestanding walls of the work stations. Because the freestanding walls are adapted to be rearranged from one pattern of organization to another, the work stations can be quickly changed over in size, shape, orientation and arrangement to adapt the work environment system precisely to new requirements as the usage of the work space changes from time to time. The U.S. patent to Propst et al, 3,413,765, issued Aug. 16, 1966, discloses the abovedescribed concepts of the modular type work environment system. Another modular-type work environment system particularly adapted for use in office environments is manufactured and sold by Applicant's assignee, Herman Miller, Inc. of Zeeland, Michigan, under the trademark ACTION OFFICE.

It has been found desirable to carry the flexible work space concept into the factory where flexibility and versatility are also major advantages. Heretofore, he work environment systems have been designed for the office environment and the adaptability of such systems for the factory environments has met with limited success. The office systems do not have the same requirements for ruggedness as the factory and thus have had limited applicability to factory environments. Various connector devices for connecting together the freestanding walls along longitudinal ends thereof have been devised. It has been found desirable to provide connector devices which not only securely connect together the freestanding walls at various predetermined angles with respect to each other, but which can also facilitate relatively quick knock-down and reassemblage of the walls into various geometric configurations. Connectors of this type are disclosed in U.S. Patents 3,430,997 issued Mar.4, 1969, and 3,425,171, issued Feb.4, 1969. These types of connectors rely on wedging principles wherein a vertical draw bolt is tightened to draw together adjacent frames. Such connectors work very well in an office environment but may not be sufficiently robust for factory applications.

Other connectors rely on offset brackets fixed at top and bottom portions of the freestanding walls to secure the same together. The offset brackets, however, are thought to be unsightly as they project outwardly from the freestanding walls. In some connector systems, provision is made for connecting two or more freestanding walls in a specific geometric configuration, for example, three walls in a Y-shaped configuration as shown in the U.S. patent to Korell, 3,842,555, issued Oct.22, 1974.

In most cases, the connectors are adapted for the office panel environment and do not have the necessary rigid construction to withstand the rigors of the factory environment.

SUMMARY OF THE INVENTION

The problems inherent in the prior art system are obviated by the modular work space management system according to the invention which comprises freestanding frame modules and freestanding tables, all of which are selectively arranged around a room in a preplanned configuration. Mobile carts are also movable around the room between the frame modules and freestanding tables. Each of the frame modules and the tables mount horizontal work surfaces for conducting work activity. Each of the mobile carts, the freestanding tables and the freestanding frame modules have common structural components comprising rigid open rectangular frame members having vertical frame members and horizontal frame members, each of the vertical frame members being rectangular and tubular in cross-section and having a series of vertical slots for hanging functional components thereon. The horizontal frame members have ends abutting and rigidly joined to the vertical frame members, the horizontal frame members further being rectangular in cross-section and having lips extending vertically along each corner for supporting hanging components and the like.

Support brackets have a vertical edge and a horizontal edge with hooks on the vertical edge adapted to engage the vertical slots in the vertical frame members. First pairs of support brackets are mounted on at least some of the vertical frame members at or above a central portion thereof in horizontally spaced, aligned positions. Shelves and work surfaces are mounted to the horizontal edges of at least some of the support brackets whereby the shelves and work surfaces are supported by the support brackets.

Second pairs of the support brackets are positioned on a bottom portion of the vertical frame members with the horizontal edge facing downwardly, whereby the second pairs of support brackets form stabilizing feet for at least some of the frame members.

Wheels are mounted to the horizontal edges of certain of the second pairs of support brackets to provide mobility to certain of the frames.

Cabinets having rear surfaces with depending hooks mounted thereon for engaging the vertical slots in the vertical frame members are mounted to some of the frames through the depending hooks and vertical slots on the frame members. Open-top trays are formed by side walls and a bottom wall and have a depending hook portion extending from the top of one side wall and in spaced relationship thereto. The depending hook is adapted to extend downwardly behind one of the horizontal frame member lips when the one side wall abuts a front face of the one horizontal frame member to thereby support the trays from the horizontal frame members. The trays are supported on at least some of the horizontal frame members through depending hook portions and horizontal frame lips.

Panels have a height and width adapted to fit in an open space between the horizontal and vertical frame members and have a thickness adapted to fit between the lips of the horizontal frame members. The panels are positioned within the open spaces of at least some of the frames with a bottom surface of each of the panels resting on a lower horizontal frame member between upstanding ones of the lips and an upper surface thereof is positioned between downward ones of the lips on an upper of the horizontal frame member. Thus, panels are retained in the open space of the frame(s) by the upstanding lips on the lower horizontal frame member and by downward lips on the upper horizontal frame member.

The horizontal and vertical frame members themselves are joined together rigidly. In one embodiment, the horizontal and vertical frame members are joined by welding. In another embodiment, the horizontal and vertical frame members are joined through a bolt-and-nut connection. The bolt-and-nut connection has interengaging means, preferably projections on the ends of the horizontal frame members and openings in one wall of the vertical frame member, to prevent lateral and rotational movement of the horizontal frame members with respect to the vertical frame members.

Further according to the invention, the rectangular frames are rigidly joined together at vertical side edges thereof through frame connector means. The frames can be joined together at various angles with respect to each other, including 90°, 135° and 180°.

The frame connector means comprise openings in opposite faces of adjacent first and second vertical frame members, with the openings being in registry with each other. First and second draw blocks are mounted respectively in the first and second frame members in registry with the openings in the side faces thereof. Horizontal bores are provided in the draw blocks in registry with the openings in the side faces. At least the first draw-block bore is threaded. A bolt extends through the draw-block bore in the adjacent first and second vertical frame members, the bolt having a threaded end which is adapted to threadably engage the threaded bore in the first draw block while being retained by the second draw block to draw the adjacent vertical frame members together as the bolt tightens.

Preferably, the bolt has an unthreaded portion and a head on an end opposite to the threaded end of the bolt. The head is adapted to abut an inner portion of the second draw block and the unthreaded portion extends through the bore in the second draw block when the bolt head abuts the inner end of the second draw block. In a preferred embodiment, the bore in the second draw block is also threaded and the bolt has a length substantially the lateral width of the vertical frame member. The bolt threaded end is adapted to thread into the second draw block threaded bore as well so that the bolt can be stored wholly within the vertical frame member when the vertical frame members are unconnected to each other.

The frame connector further comprises a drawblock holder means to releasably retain the draw block in the vertical frame member. The draw-block holder means comprises a tubular body which extends through the opening in an inner wall of the vertical frame member and the draw block is releasably retained within the tubular body. Preferably, portions of the vertical frame extend above an upper of the horizontal frame members and the frame connector means are positioned in the portions above the upper horizontal frame member. Likewise, portions of the vertical frame members extend below a lower one of the horizontal frame members in the rectangular frame and the frame connector means are positioned in the portions below the lower horizontal frame member.

BRIEF DESCRIPTION OF THE DRAWINGS

The invention will now be described with reference to the drawings in which.

DESCRIPTION OF THE PREFERRED EMBODIMENTS

Figure 1:
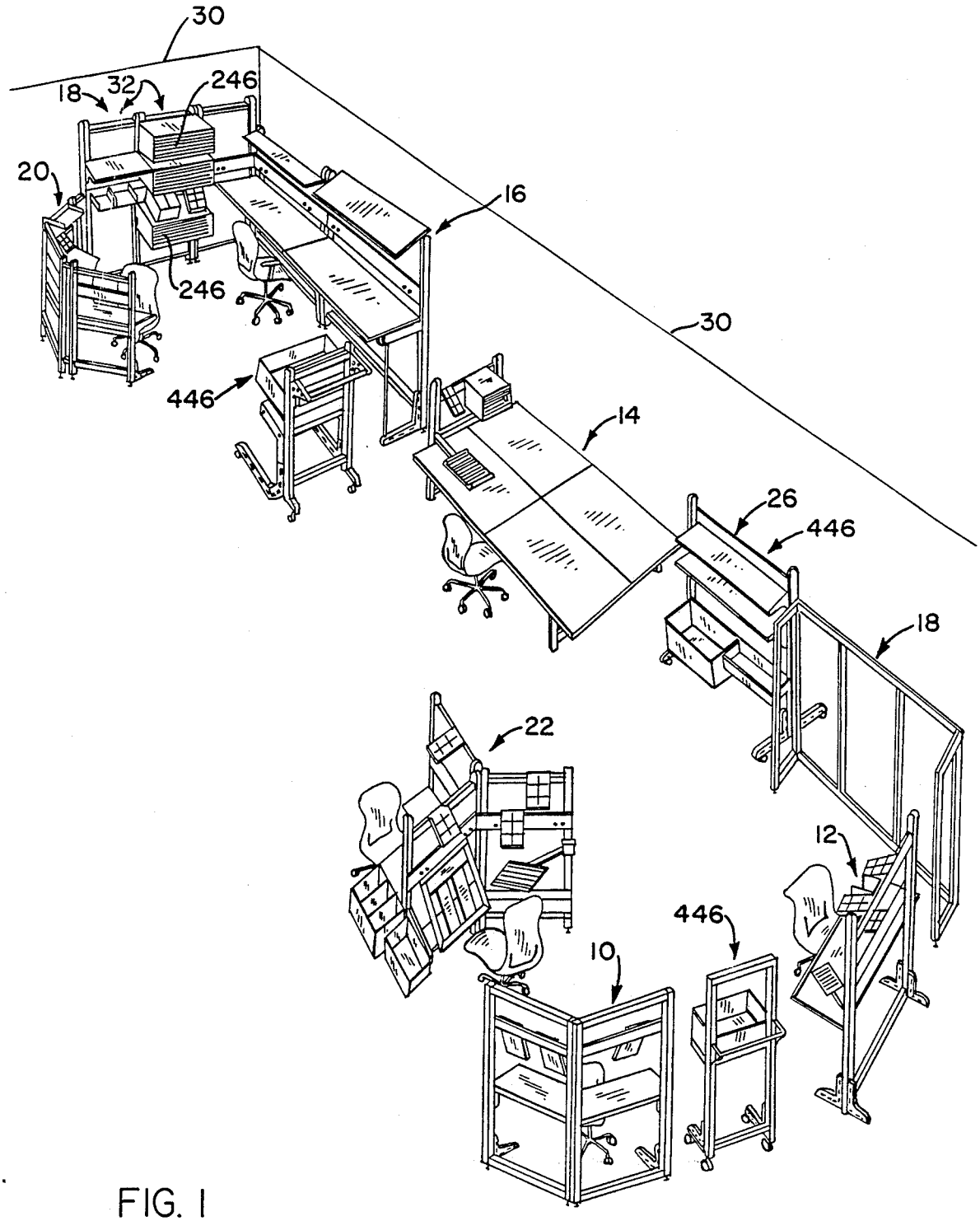
FIG. 1 is a perspective view of a work environment system according to the invention.

Referring to the drawings, and in particular to FIG. 1, there is shown a work environment system for factory and commercial environments, wherein a number of work stations are spaced about a room having fixed interior walls 30. The work stations are formed from freestanding frame modules 32 configured to provide different sizes and shapes of work stations to perform different functions. Shown in FIG. 1 are a 135° assembly work station 10, a table work station 12, a freestanding work table 14, a test station 16, a desk station 20 and a Y-shaped work station 22. A plurality of freestanding modules 32 can be connected together in linear end-to-end juxtaposition to form a freestanding wall 18. One of a number of transport carts 446 is positioned adjacent the test station 16. Another embodiment of the transport cart 446 is positioned adjacent the table work station 12. A further embodiment of the transport cart 446 is provided for transporting totes containing work-in-process parts from station to station and is positioned adjacent work station 10.

The particular arrangement of frame modules 32 in forming the varius work stations will depend on the purposes of the work stations, which can vary widely. For example, a work station may be adapted for assembly of specific products from numerous component parts stored at the work stations. This concept of work station product assembly is somewhat in contrast to the typical assembly line method of product assembly, but has been found to work well in certain environments and with particular types of products.

In addition, the work stations can include various functional components, such as storage cabinets, work surfaces and the like (as hereinafter described in detail) which can be arranged to achieve functionally efficient work stations commensurate with particular user requirements.

Figure 2:
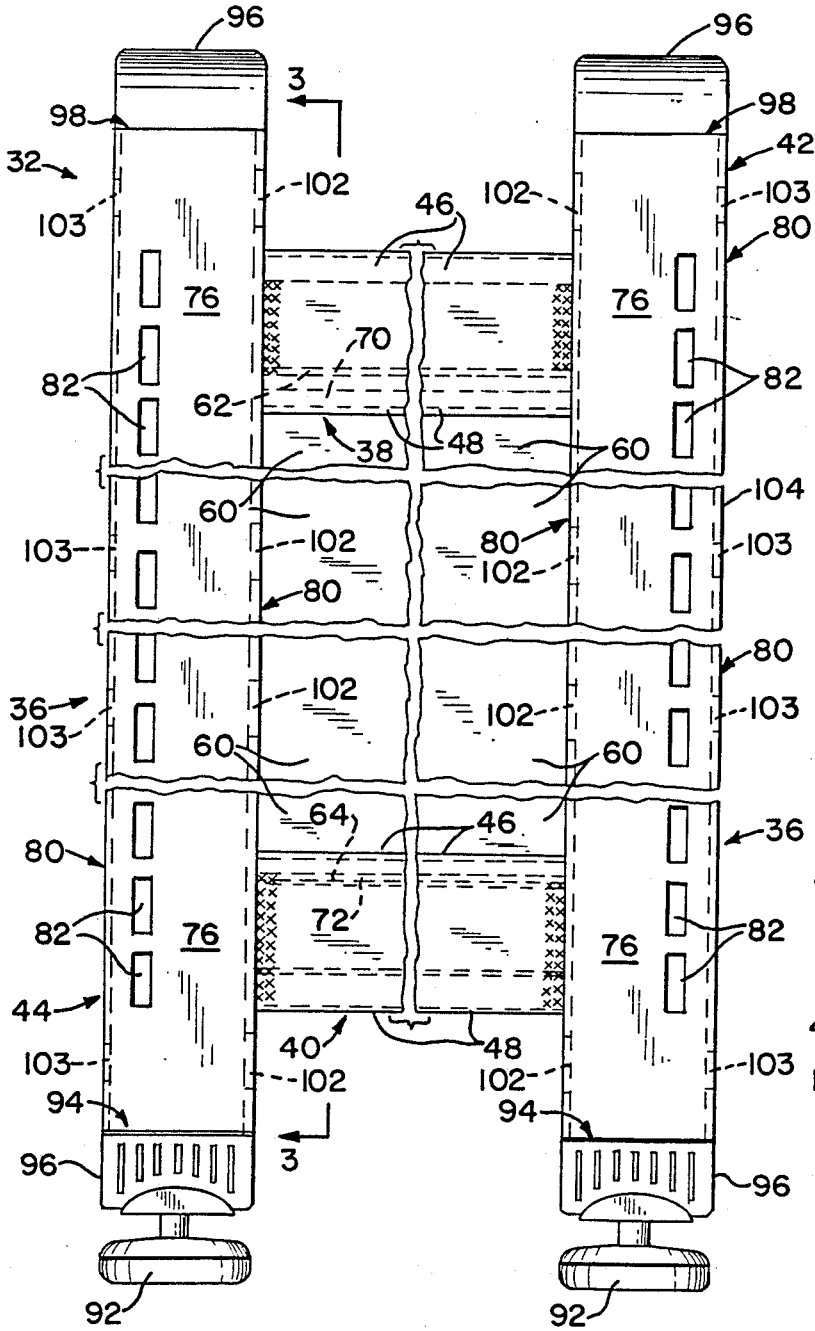
FIG. 2 is a front elevational view of a freestanding module of the work environment system shown in FIG. 1.
Figure 3:
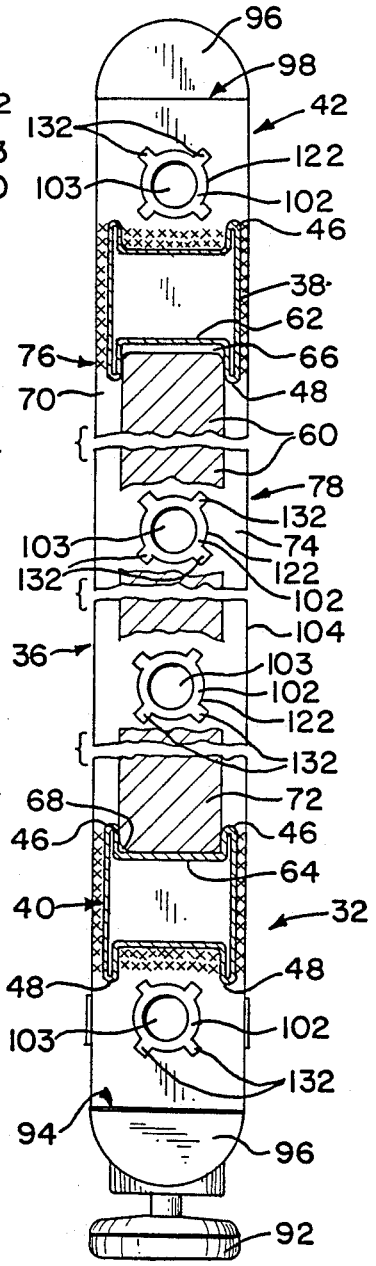
FIG. 3 is a side elevational view of the freestanding module illustrated in FIG. 2.

The freestanding frame modules 32 can be of various size, but are all substantially rectangular in shape. As shown in FIGS. 2 and 3, each rectangular frame module 32 can comprise a pair of vertical frame members 36 and upper and lower horizontal frame members 38, 40 securely attached to upper and lower portions 42, 44 of the vertical frame members. In this manner, the vertical and horizontal frame members form a frame structure for the modules 32. The vertical and horizontal frame members can be secured together by any suitable connecting means, such as by welding.

As shown in FIG. 3, the horizontal frame members 38, 40 are substantially H-shaped, in cross section, and in this respect include pairs of upper and lower lips 46, 48 which extend along the full length of the horizontal frame members on opposite sides thereof. The upper and lower horizontal frame members 38, 40 are preferably constructed of roll formed steel.

The lower lips 48 of the upper, horizontal frame member 38 and the upper lips 46 of the lower, horizontal frame member 40 function to removably hold an insert panel 60. Specifically, as shown in FIG. 3, the upper, horizontal frame member 38 includes horizontal wall 62 positioned between and preferably formed integral with the lower lips 48; and the lower, horizontal frame member 40 includes an upper, horizontal wall 64 positioned between and preferably formed integral with the upper lips 46. The lower lips 48 and the horizontal wall 62 of the upper, horizontal frame member 38 form a first channel 66 extending along the full length thereof. The upper lips 46 and the horizontal wall 64 of the lower, horizontal frame member 40 form a second channel 68 extending along the full length of the same. Upper and lower horizontal ends 70, 72 of the panel 60 are engageable with the first and second channels 66, 68, respectively. As can be seen in FIG. 3, the first channel 66 is deeper than the second channel 68. This design facilitates the mounting of the panel 60 within the channels, wherein the upper, horizontal end 70 of the panel 60 is first inserted into the upper channel. Subsequently the lower, horizontal end 72 of the panel is dropped into the second channel. The first channel is of a sufficient depth to allow insertion of the lower end of the panel into the second channel without substantial interference of the upper lips 46 of the lower, horizontal frame members 40 with the lower end 72 of the panel.

The panels 60 can have a variety of aesthetic as well as functional characteristics. For example, the panels 60 can be either transparent or translucent. In addition, the panels 60 can function as sound barriers between work areas located on opposite sides of the freestanding modules 32 and for this purpose can include acoustical sound absorbing foam (not shown). Further, the panels 60 can have incorporated therein heater units (not shown) and/or cooling fans (not shown) for adjusting environmental conditions at the work stations 30.

As shown in FIGS. 2 and 3, each vertical frame member 36 is hollow and substantially square, in cross section, and therefore comprises oppositely positioned front and back walls 76, 78 and a pair of oppositely disposed side walls 80. The upper and lower horizontal frame members 38, 40 may be secured to any of the walls of the vertical frame members, but preferably are mounted to the side walls 80 of the same. The front and back walls 76, 78 include a plurality of vertically positioned, equidistant spaced slots 82 extending therethrough. The slots 82 function as positions of attachment for the various functional components, work surfaces, storage cabinets and the like (as hereinafter described), to the vertical frame members 36 of the work stations 30.

Figure 19:
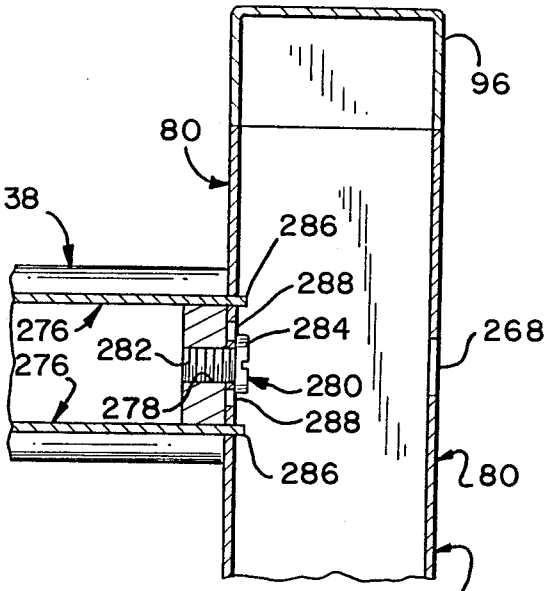
FIG. 19 is a cross-sectional view of the horizontal and vertical frame members illustrated in FIG. 18.
Figure 18:
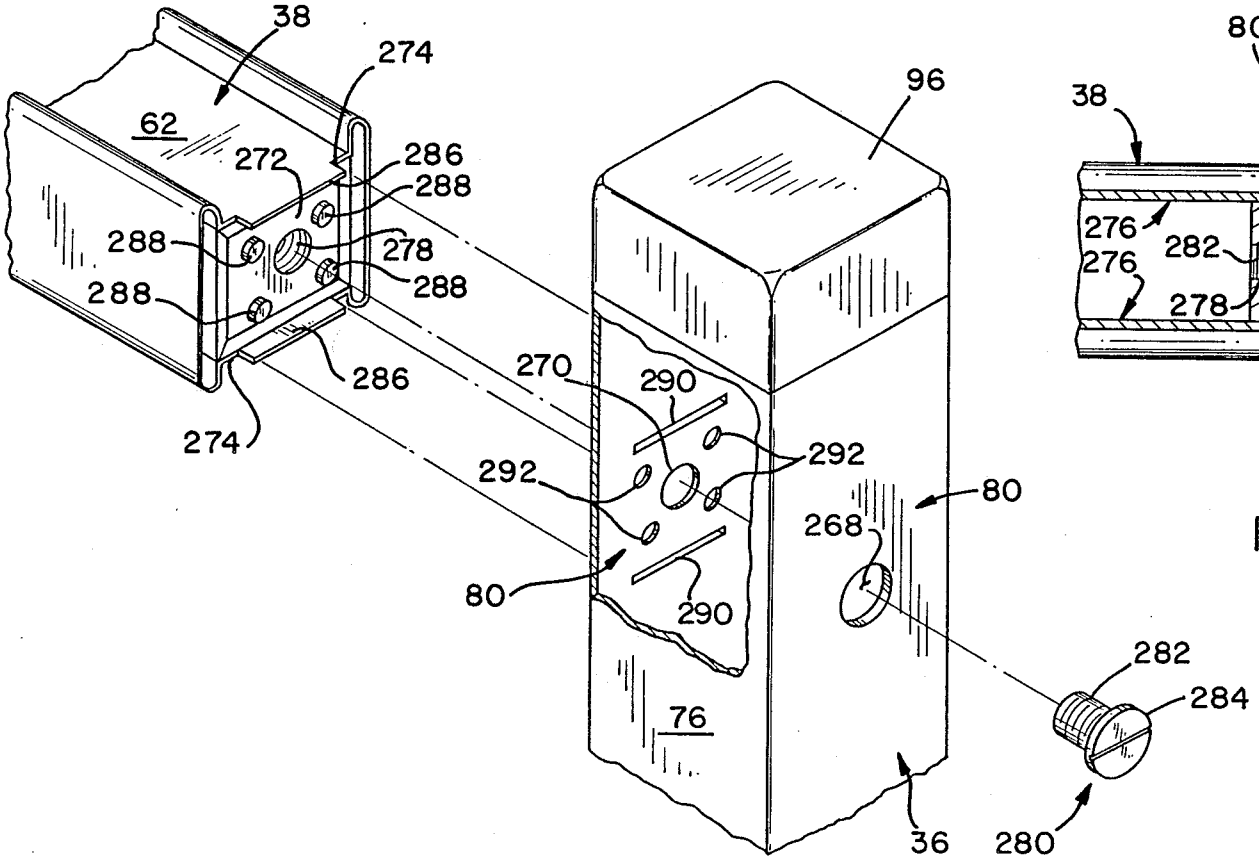
FIG. 18 is an exploded perspective view of a bolted connection between a horizontal frame member and a vertical frame member of the freestanding module.

As stated above, the horizontal frame members 38, 40 can be rigidly secured to the vertical frame members 36 by any suitable connecting means, such as by welding. Alternatively, a bolted connection can be provided between the vertical and horizontal frame members. To this end, referring to the single bolted connection between vertical and horizontal frame members 36, 38 illustrated in FIGS. 18 and 19, the vertical frame member is provided with a pair of aligned large and small orifices 268, 270 extending through opposing side walls 80 thereof, with the small orifice 270 extending through the side wall to which the horizontal frame member is rigidly secured (hereinafter, sometimes referred to as the "inside wall"). The horizontal frame member 38 is fitted with a nut insert 272 which is housed within the horizontal frame member 38, positioned flush with transverse axial edges 274 of the horizontal frame member and rigidly secured to inside walls 276 thereof as by welding. In addition, the nut insert 272 includes a threaded bore 278. A bolt 280 is also provided and has a threaded shaft 282 and a head 284 of sufficient size to fit through large orifice 268, but not through the small orifice 270.

To mount the horizontal frame member 34 to the vertical frame member 36, the axial edges 274 of the former are set in matting engagement with the inside wall 80 of the latter such that the threaded bore 278 is aligned with small orifice 270 and the horizontal walls 62 of the horizontal frame member 34 are positioned in substantially horizontal planes. Subsequently, the bolt 280 is inserted through large orifice 268 and the shaft 282 of the bolt is threadably inserted within the bore 278 so as to position the head 284 of the bolt in tight engagement with the inside wall 80 of the vertical frame member to tightly draw the horizontal frame member to the vertical frame member.

To facilitate proper orientation of the horizontal frame member 38 with respect to the vertical frame member 36 when mounting the former to the latter, the horizontal frame member is provided with a pair of axially-projecting tabs 286 on the transverse axial edges 274 of the horizontal walls 62 of the horizontal frame member; the nut insert 272 is provided with a plurality of projections 288; and the vertical frame member 36 includes a pair of elongated slots 290 and a plurality of third orifices 292 extending through inside wall 80. The slots 290 and the third orifices 292 are positioned around the small orifice 270 in a predetermined pattern so as to be aligned with the projecting tabs 286 and projections 288, respectively, when the horizontal frame member is mounted to the vertical frame member in the manner described above. Therefore, in mounting the horizontal frame member 38 to the vertical frame member 36, the tabs 286 and projections 288 are set in full registry with the third orifices 292 and the slots 290, respectively, to automatically set the horizontal frame member in proper orientation with respect to the vertical frame member so that the horizontal walls 62 are set in substantially horizontal planes and the bore 278 is aligned with the small orifice 270.

Figure 3A:
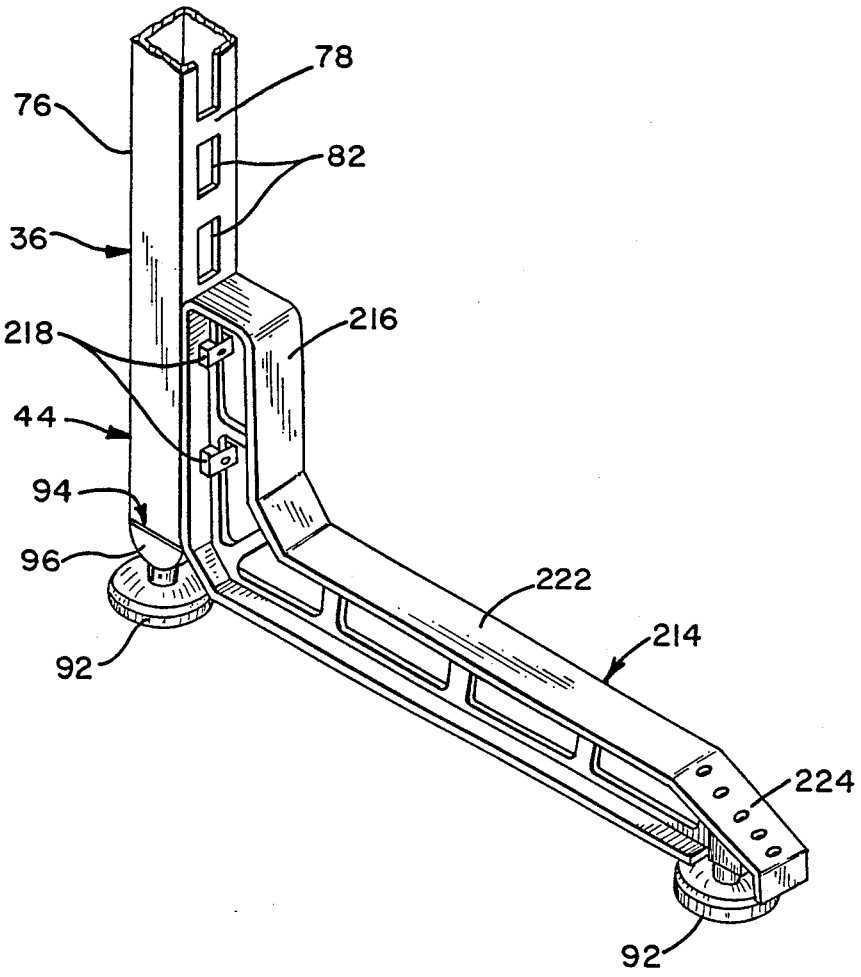
FIG. 3A is a perspective view of a vertical frame member of the freestanding module and having secured thereto a floor-engaging support bracket.
Figure 4:
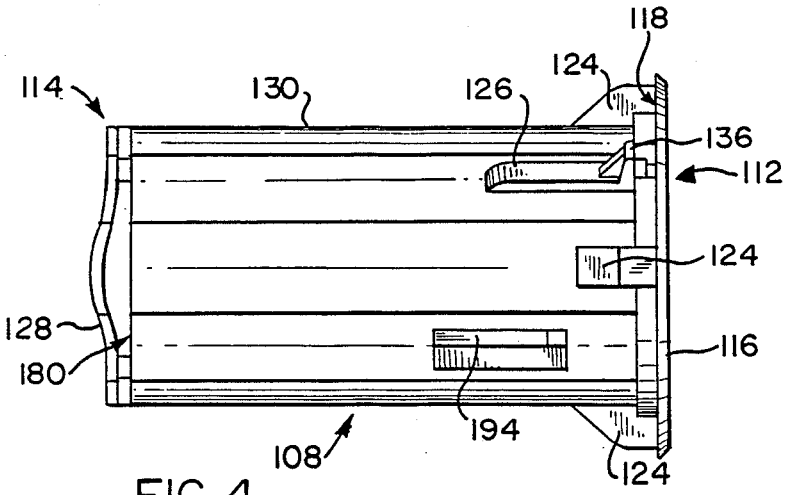
FIG. 4 is a side elevational view of a draw block holder of a connector for securing together two or more of the freestanding modules in end-to-end relationship.
Figure 5:
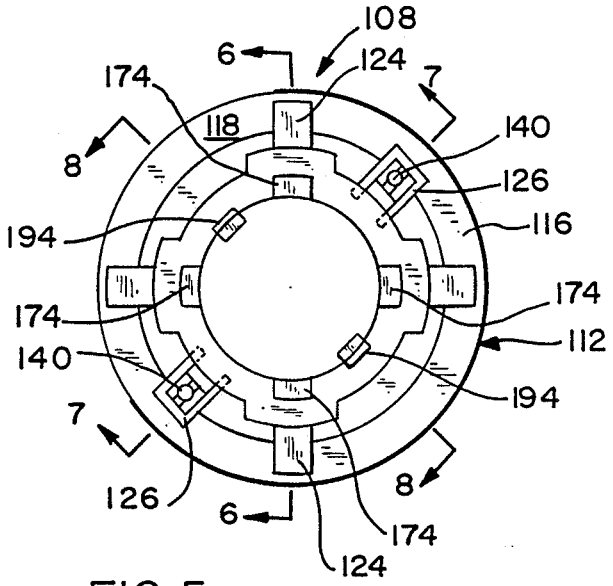
FIG. 5 is a rear elevational view of the draw block holder illustrated in FIG. 4.
Figure 6:
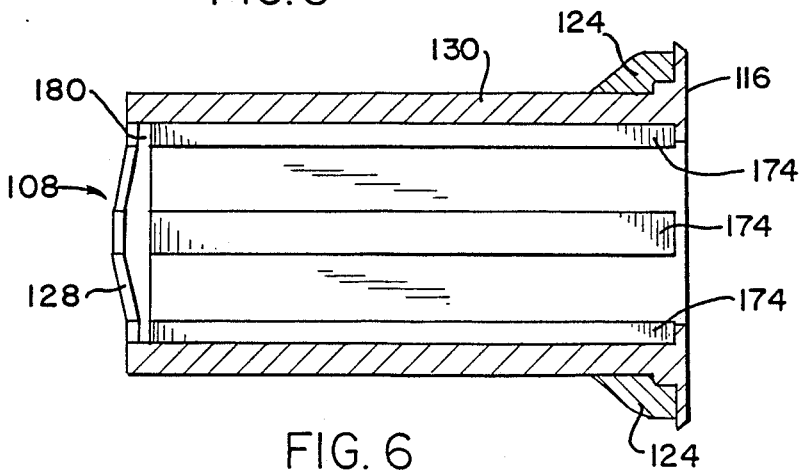
FIG. 6 is a cross-sectional view of the draw block holder taken along lines 6—6 of FIG. 5.
Figure 7:
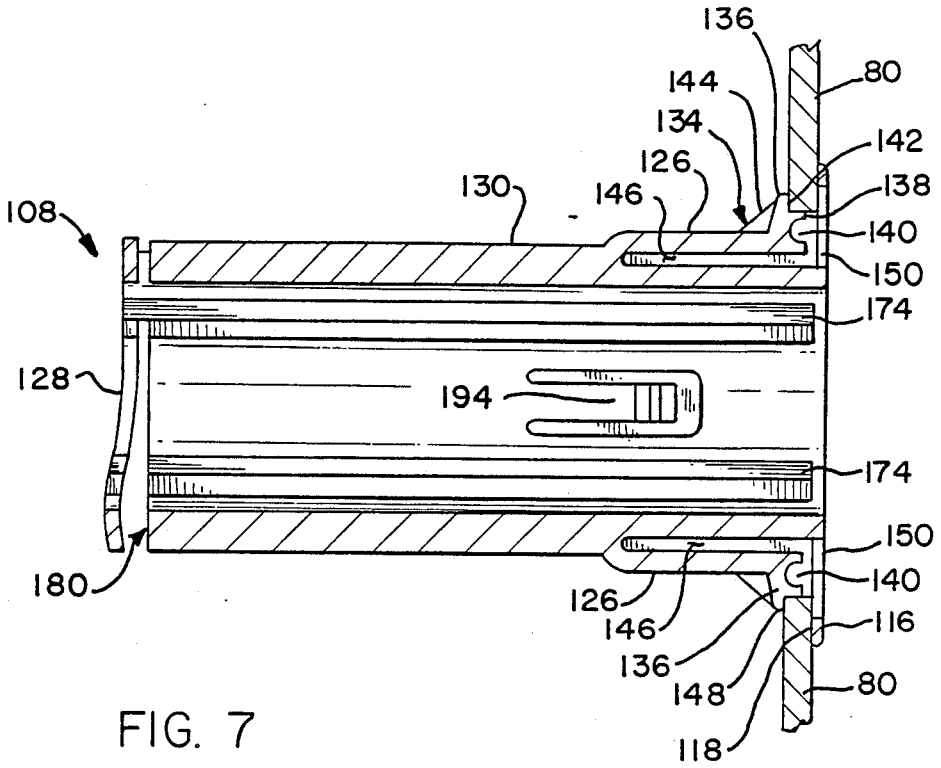
FIG. 7 is a cross-sectional view of the draw block holder taken along lines 7—7 of FIG. 5.

In addition, as illustrated in FIGS. 2, 3 and 3A, the freestanding module 32 is floor engaging and in this regard includes floor glides 92 and support brackets 214. The floor glides 92 are threadably mounted to and within threaded bores (not shown) in the bottom axial ends 94 of the vertical frame members 36 and thus support the same from the floor. The floor glides are also vertically adjustable with respect to the vertical frames 36 and thus function to independently adjust the height of the vertical frame members relative to each other so as to position the same at substantially the same elevation and the horizontal frame members 38, 40, in substantially horizontal planes. In this manner the glides 92 compensate for an uneven floor.

Referring specifically to FIG. 3A, the support brackets 214 function to stabilize the freestanding module 32 in a substantially vertical plane. To this end, each support bracket 214 comprises a vertical part 216 engaging the front wall 76 or the back wall 78 of a vertical frame member 36 at the lower portion 44 thereof and having secured thereto a number of rearwardly projecting bolts 218 in registry with an equal number of slots 82 of the vertical frame member. The support bracket 214 is secured to the vertical frame member 36 by nuts (not shown) engaging the bolts 218. The support bracket 214 also includes a horizontal part 222 extending outwardly from the vertical part 216 a sufficient distance to provide the module 32 with a broad base of support so as to stabilize the same in a substantially vertical plane. The outer end 224 of the horizontal part 222 includes another floor-engaging vertically adjustable glide 92. Specifically, the glide 92 on the bracket 214 includes an upwardly projecting threaded arm (not shown) which threadably engages a threaded bore (not shown) in the support bracket. The height of the glide 92 can be adjusted with respect to the support bracket by setting the former in more or less threaded engagement with the latter. By adjusting the height of the glide 92 relative to the vertical frame member 36, the second glide can adjust the position of the freestanding module 32 so as to dispose the same in a substantially vertical plane. It should be noted that more than one support bracket 214 can be mounted to the vertical frame members of a freestanding module 32. One support bracket 214 can mount to each of the front and back walls of each vertical frame member. The number of support brackets 214 mounted to the module 32 and their arrangement with respect thereto will be dictated by the amount of weight required to be supported by the module 32 and the distribution of such weight.

Also, as illustrated in FIGS. 2 and 3, to enhance the aesthetic attractiveness of the freestanding module 32, decorative end caps 96 are provided and mount to the bottom and top axial ends 94, 98 of the vertical frame members 36 in a snap-fit relationship. Further, the vertical frame members 36 can be manufactured in a variety of lengths so as to vary the height of the free standing module 32 to accommodate particular user requirements.

As indicated above, a freestanding wall 18 can be created by securely connecting together two or more modules 32 in side-by-side juxtaposition by the use of connectors 100. The connectors 100 can be similarly employed to securely mount together two or more freestanding modules 32 in a number of angular configurations. To this end, as shown in FIGS. 2 and 3, the vertical frame members 36 have substantially circular, large openings 102 and small openings 103 extending through the side walls 80 thereof on upper, lower and central portions 42, 44, 104, of the vertical frame members. Preferably, the vertical frame members include corresponding pairs of aligned large and small openings 102, 103 extending through opposing side walls 80 of the vertical frame members.

The connector 100 comprises a draw block 106, a draw block holder 108 and a cap screw 110. The cap screw 110 is set in threaded engagement with the draw block. The draw block 106 is set in telescopic engagement with the draw block holder 108. Thus, the cap screw is housed within the draw block and the draw block holder. The draw block holder, along with the draw block and cap screw, is housed within the hollow, vertical frame member between opposing side walls 80 and in registry with the openings 102, 103.

As shown in FIGS. 4–8 and 12 the draw block holder 108 is a hollow, substantially cylindrical member having a front end 112, a rear end 114 and a doughnutshaped head 116 on the front end. The draw block holder 108 is slidably set in registry with an opening 102 in a side wall 80 of the vertical frame member 36 such that a rear surface 118 of the head 116 mattingly engages a front face 120 of the vertical frame member 36 to thereby cover an edge 122 of the opening 102.

The draw block holder 108 is held securely in position in registry with openings 102, 103 by a plurality of keys 124 and first cantilevered springs 126 and a leaf spring 128. Specifically, the keys 124 are formed integral with an outer wall 130 of the draw block holder 108 at spaced intervals on the front end- 112 thereof. The keys 124 engage an aligned, corresponding number of notches 132 in the edge 122 of the opening 102. In this manner, the keys 124 prevent rotation of the draw block holder 108 with respect to the vertical frame member 36.

In addition, a plurality of first cantilevered springs 126 are formed integral with an outer wall 130 of the block holder 108 at spaced intervals on the front end 112 of the same. Each first cantilevered spring 126 comprises, on the front portion 134 thereof, a upstanding lip 136, a shelf 138 and a hole 140. When the draw block holder 108 is mounted within the opening 102 of the vertical frame member 36, the wall 80 abuts the shelf 138 and is securely sandwiched between a front portion 142 of the lip 136 and the rear surface 118 of the head. In this manner, the wall 80 of the vertical frame member 36 interferes with horizontal movement of the draw block holder 108 parallel with a longitudinal axis thereof. In addition, the first cantilevered spring 126 is set in snap-fit engagement with the wall 80 so that when the draw block holder 108 is being set in full registry with the opening 102, the wall 80 first engages a rear, inclined portion 144 of the lip 136 which forces the first cantilevered spring into space 146 between the spring and the outer wall 130 and permits the wall 80 to slide on the rear portion 44 and over an apex 148 of the lip until the wall 80 rests on the shelf 138, at which time the first cantilevered spring resiliently responds out of space 148. To remove the wall 80 from snap-fit engagement with the first cantilevered springs 126, to thereafter allow removal of the draw block holder 108 from the vertical frame member 36, an operator registers a pointed implement (not shown), such as needle-nosed pliers, with the holes 140, through offices 150 extending through the head 116 and positioned in registry with the holes, and subsequently forces the first cantilevered springs into spaces 148 to free the wall 80 from interference with the lips. Thereafter, the block holder 108 may be removed from engagement with the opening 102.

The leaf spring 128, like the keys 124 and the cantilevered springs 126, also function to hold the draw block holder 108 in secure engagement with the opening 102. However, the leaf spring performs this function in conjunction with the draw block 106 and therefore will be explained hereinafter in detail in connection therewith.

As illustrated in FIGS. 9–12, the draw block 106 is a hollow, substantially cylindrical member comprising a front part 152, a rear part 154 and a bore 156 extending through a central, longitudinal axis of the draw block. The bore has an enlarged portion 158 at a front portion and a small threaded portion 160 at a rear portion thereof. The draw block 106 further comprises a circular flange 162 on the front part 152 and positioned rearwardly a predetermined distance from a front, axial edge 164 of the draw block. A number of elongated, first splines 166 are formed integral with or rigidly secured to and extend along the full length of an outer wall 168 of the draw block. A series of equidistantly spaced, forwardly-projecting serrations 170 are formed integral with or rigidly secured to a peripheral front side 172 of the flange 162.

Figure 12:
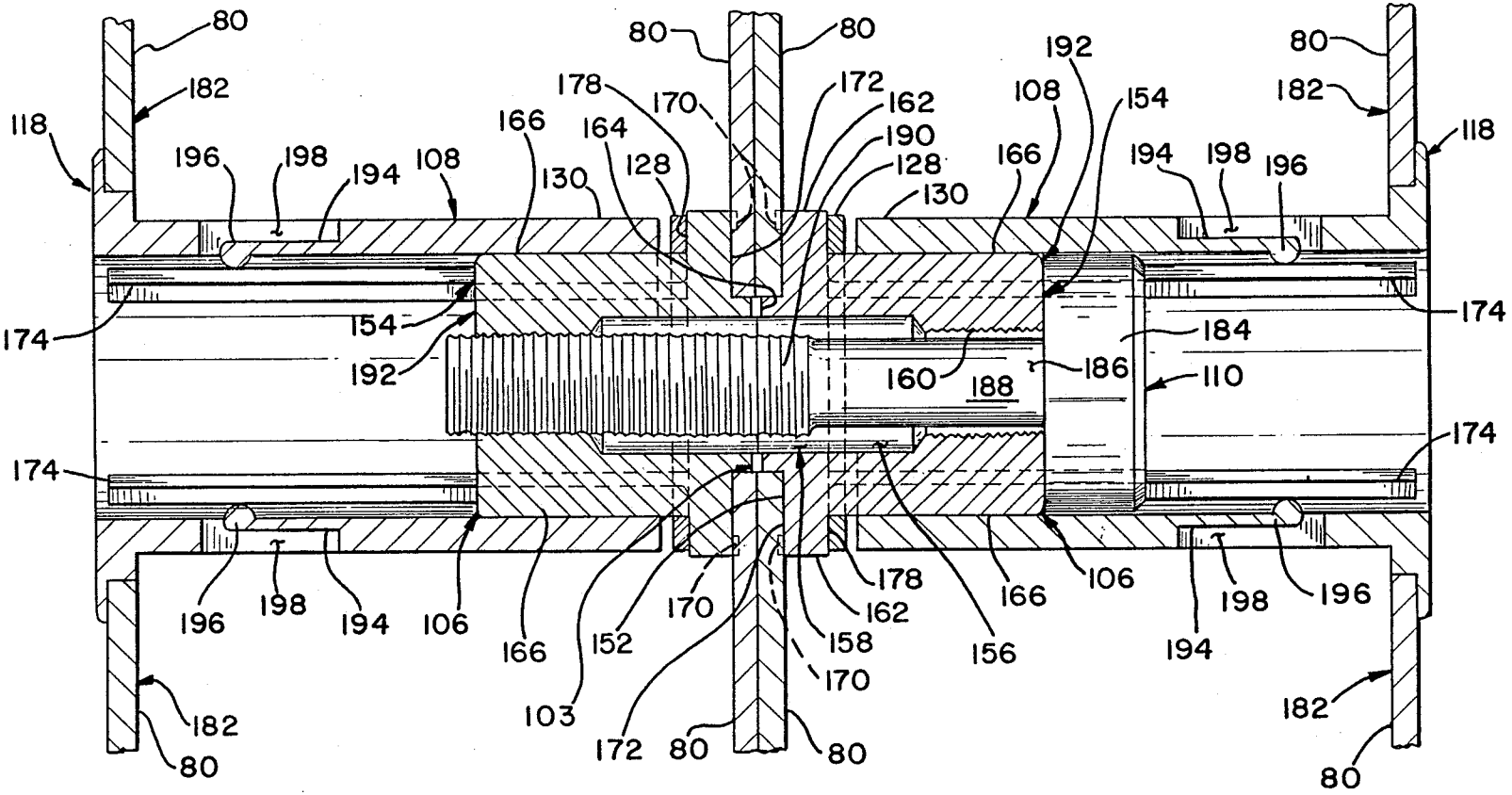
FIG. 12 is a cross-sectional view of a pair of vertical frame members of two adjacent freestanding modules secured together by the connector.
Figure 13:
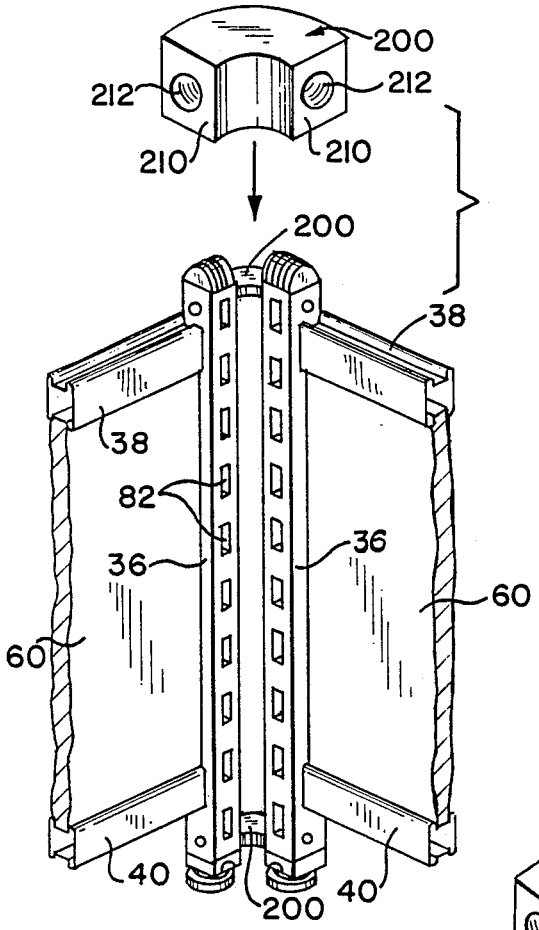
FIG. 13 is a perspective view of two freestanding modules joined together at 90° with respect to each other by a 90° , two-way connector block.
Figure 14:
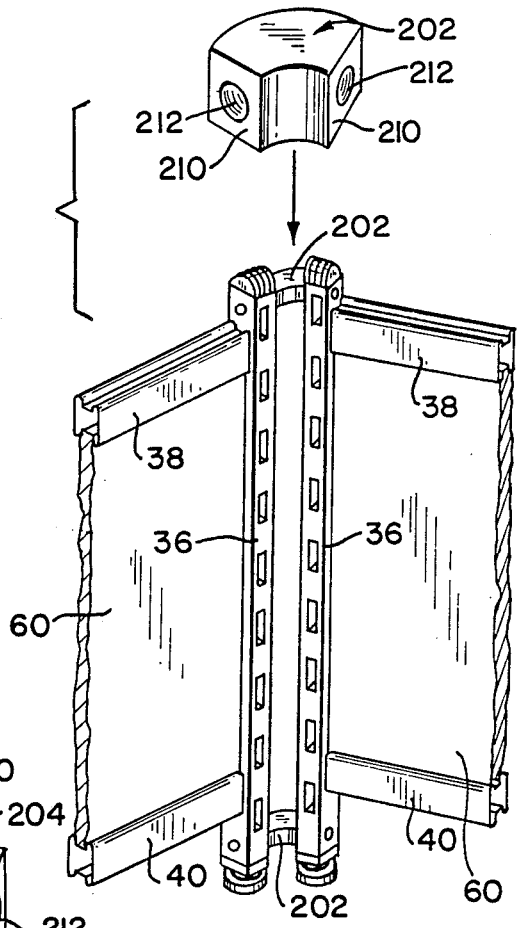
FIG. 14 is a perspective view of two freestanding modules secured together at 135° with respect to each other by a 135° , two-way connector block.
Figure 15:
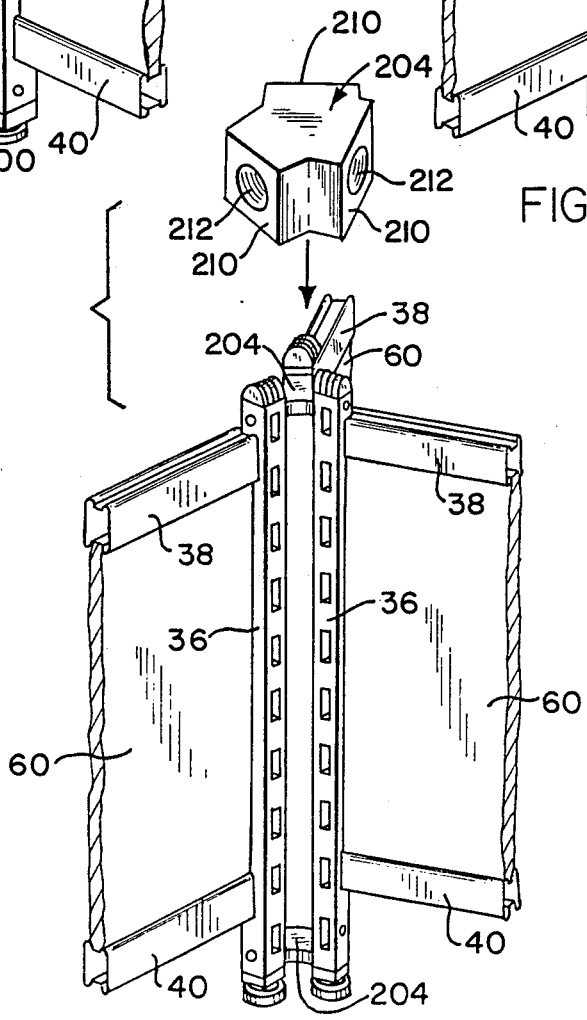
FIG. 15 is a perspective view of three freestanding modules secured together in a substantially Y configuration by a 135° , three-way connector block.
Figure 16:
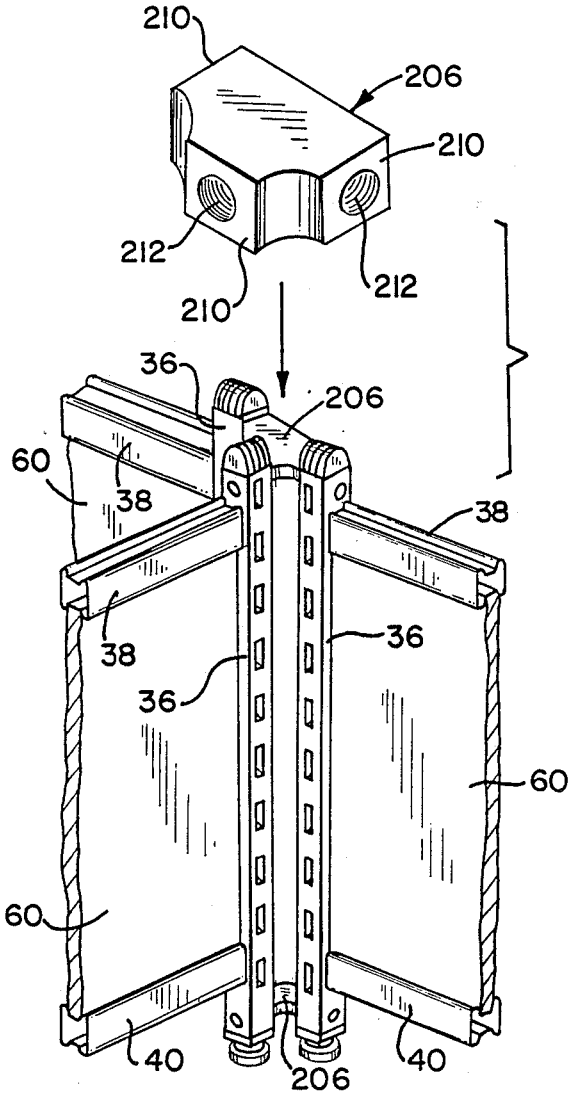
FIG. 16 is a perspective view of three freestanding modules secured together, such that two freestanding modules are positioned at 180° apart and the third module is positioned at 90° with respect to the other two modules, by a three-way, 180° connector block.
Figure 17:
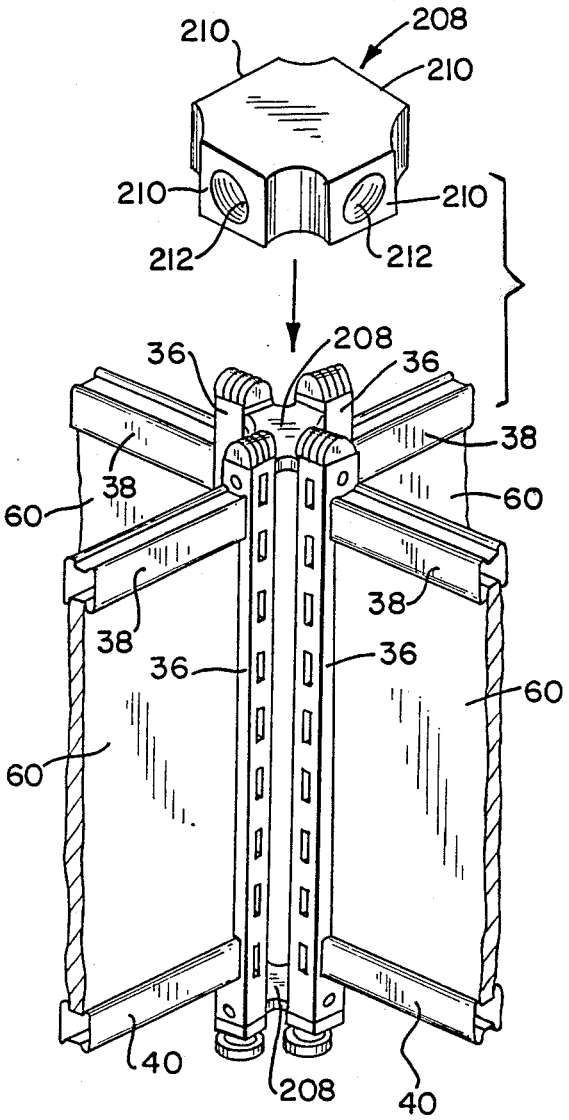
FIG. 17 is a perspective view of four freestanding modules secured together, such that each module is set at 90° with respect to its adjacent module by a four-way connector block.

As stated above, the draw block 106 is positioned in telescoping engagement with the draw block holder 108. To this end, the draw block holder 108 further includes a plurality of elongated, internal, second splines 174 formed integral with an inner wall 176 of the draw block holder 108 at spaced intervals on longitudinal axes thereof and extending along substantially the full length of the block holder. The draw block 106 is slidably engaged with the rear end 114 of the draw block holder such that a back side 178 of the circular flange 162 resiliently engages the leaf spring 128 at a rear, axial end 180 of the draw block holder and the first and second splines are set in interlocking engagement. In this manner, the first and second splines prevent rotational movement of the draw block relative to the draw block holder. When the draw block 106 is so positioned within the draw block holder 108 and the latter is set in registry with the large opening 102, the bore 156 of the draw block is set in registry with the small opening 103, the flange 162 and the serrations 170 engage a rear face 182 of the side wall 80 adjacent the small opening 103 of the same and the leaf spring 128 is biased toward the front end 112 of the draw block holder 102. In this position, the leaf spring 128 functions to bias the draw block against the side wall 80 adjacent the small opening 103 and the first cantilevered spring 126 of the draw block holder 108 against the side wall 80 adjacent the large opening 102 to thereby securely position the draw block and the draw block holder between the opposing side walls 80 within the vertical frame member 36. As can be seen in FIG. 12, when the draw block is mounted within the vertical frame member 36, the front, axial edge 164 of the draw block is positioned slightly behind the front face 120 of the wall 80 adjacent the small opening 103. In this manner, when two vertical frame members are secured together in side-by-side juxtaposition, the front, axial end 164 of the draw block does not interfere with flush engagement of the neighboring side walls 80 of the neighboring, vertical frame members 36.

As stated above, the cap screw 110 is positioned within the draw block 106 and draw block holder 108 and comprises, as illustrated in FIG. 12, a head 184 and a shaft 186 having a smooth, upper portion 188 and a threaded, lower portion 190. The cap screw 110 is positioned within the draw block 108 such that the threaded, lower portion 190 is in registry with the large wall 158 of the bore 156 and the smooth, upper portion 188 is positioned adjacent the small, threaded wall 160 of the bore 156. To so position the cap screw 110, the same is inserted into the bore 156 through the rear part 154 of the draw block 108 and then threaded onto and through the small, threaded wall 160 of bore 156. This can be done when the draw block 106 is mounted within the draw block holder 108 and the latter is mounted within the hollow, vertical frame member 36 by first inserting the cap screw 110 into the large opening 102 and subsequently threading the cap screw onto the draw block 106 as described above. When the cap screw 110 is so threaded, forward, rotational force is applied to the cap screw which force is transmitted to the draw block to thereby force the front, axial edge 164 of the same against the rear face 182 of the vertical frame member 36 to thus force the serrations 170 tight engagement with the same and thereafter pre-vent rotational movement of the draw block with respect to the vertical frame member. The cap screw 110 is permitted to slide within the bore 156 along the longitudinal axis of the draw block 106. This movement is limited in a direction toward the front part 152 of the draw block 106 by interference of the head 184 of the cap screw 110 with the rear, axial edge 192 of the draw block and in a direction toward the rear part 154 of the draw block by interference of the threaded, lower portion 190 of the cap screw with the threaded, small wall 160 of the bore 156.

Figure 8:
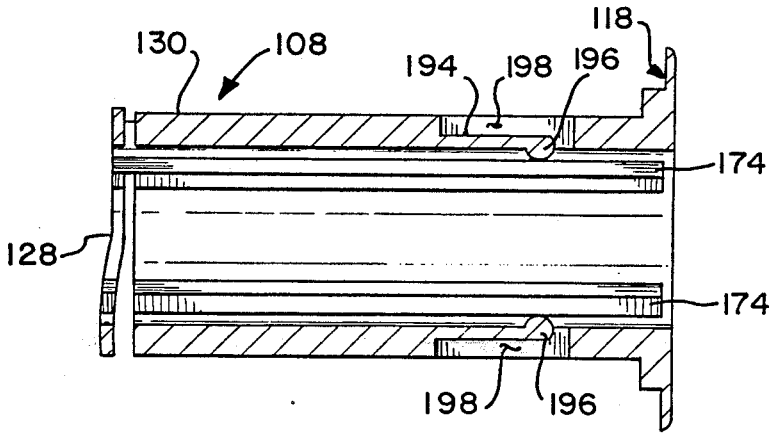
FIG. 8 is a cross-sectional view of the draw block holder taken along lines 8—8 of FIG. 5.
Figure 9:
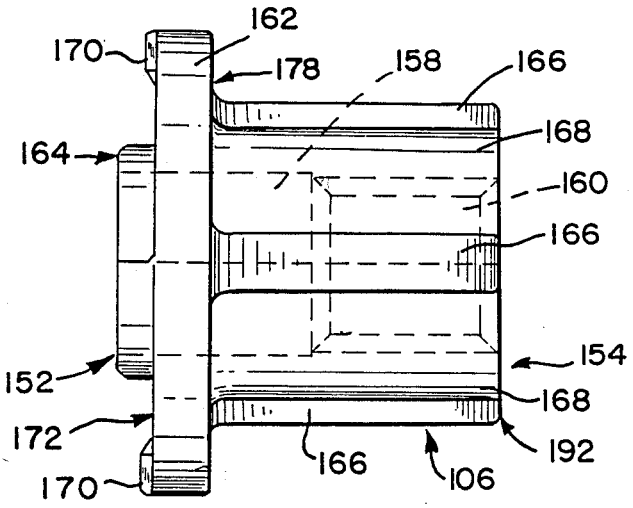
FIG. 9 is a side elevational view of a draw block of the connector.
Figure 10:
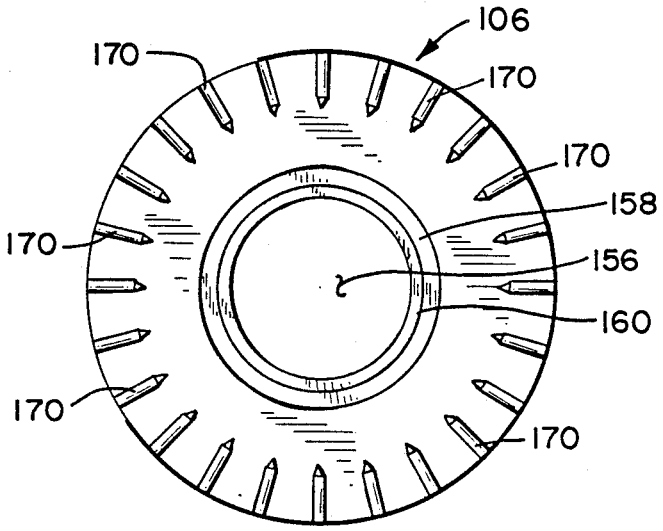
FIG. 10 is a front elevational view of the draw block illustrated in FIG. 9.
Figure 11:
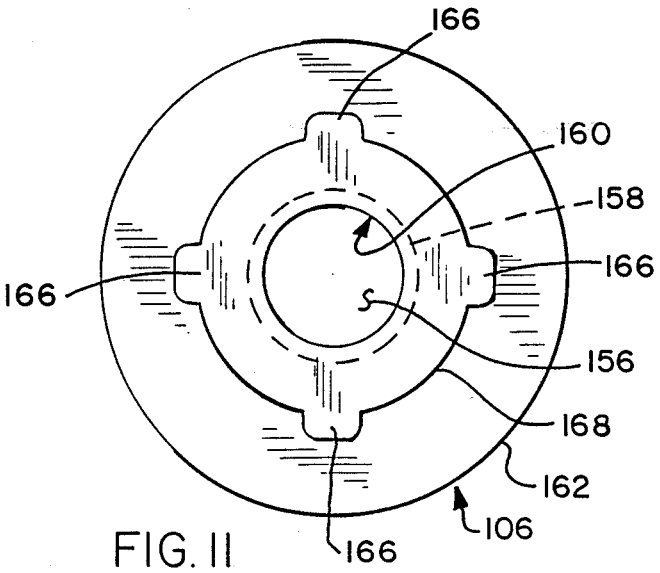
FIG. 11 is a rear elevational view of the draw block illustrated in FIG. 9.

So positioned within the bore 156 of the draw block 106, the cap screw 110 can assume two positions: a shipping position and an assembly position. To this end, the draw block holder 108, as illustrated in FIGS. 8 and 12, further comprises a plurality of second internal, cantilevered, resilient springs 194 formed integral with or rigidly secured to the inner wall 176 of the draw block holder at the front end 112 thereof. Each second cantilevered spring 194 includes a second lip 196. During shipping of the connector 100, the same is positioned within the vertical frame member 36. In the shipping position, the head 184 of the cap screw 110 is positioned on the right side of the second lips 196 as viewed in FIG. 12. Interference of the head 184 with the second lips 196 prevents movement of the cap screw toward the small opening 103 of the vertical frame member 36. Thus, during transportation of the connector 100, the cap screw 110 of the same is prevented from projecting out of the small opening 103 of the vertical frame member. In the assembly position, the head 184 of the cap screw 110 is positioned to the left of the second lips 96 as shown in FIG. 12. To so position the cap screw 110 an operator inserts, for example, his/her finger into large opening 102 and forces the head 184 toward the rear end 114 of the draw block holder which forces the second cantilevered springs 194 outward into second spaces 198 to permit movement of the head 184 past the second cantilevered springs. With the second cantilevered springs 194 no longer interfering with movement of the cap screw 110 toward the rear end 114 of the draw block holder 108, the cap screw, and specifically the threaded, lower portion 190 thereof, is permitted to leave the confines of the vertical frame member 36 through the small opening 103 and adapted to engage the draw block 106 of a connector 100 positioned within a neighboring vertical frame member 36.

To securely mount together a pair of freestanding modules 32 in side-by-side juxtaposition, the side walls 80 of a pair of vertical frame members are set in flush engagement such that the small openings 103 of the walls are in registry with one another and the front parts 152 of the draw blocks 106 of the neighboring connectors 100 are in opposing relationship. For this purpose, one of the connectors 100 does not include a cap screw 110. The cap screw 110 of the other connector 100 is then set in its assembly position as described above so that the shaft 186 of the same is forced out of its respective small opening 103 and into the small opening 103 of the adjacent, vertical frame member. Subsequently, the cap screw 110 is threaded onto the small, threaded wall 160 of the adjacent draw block 106 to securely draw together the vertical frame members in tight side-by-side juxtaposition. When two vertical frame members 36 of the same length are secured together in side-by-side relationship, connectors 100 positioned within upper and lower portions 42, 44 of the vertical frame members are utilized. On the other hand, when vertical frame members 36 of different lengths are secured together, connectors 100 within the central portions 104 of the vertical frame members may also be employed.

The connectors 100 can be similarly used to securely mount together one or more freestanding modules 32 in a plurality of angular configurations. To this end, a variety of connector blocks are used and include, as shown in FIGS. 13–17, a 90° two-way connector block 200 for mounting a pair of freestanding modules 32 together perpendicular to one another; a 135° two-way connector 202 for connecting together one freestanding module with another at 135°; a 135° three-way connector block 204 for mounting three freestanding modules together in a substantially Y-configuration such that one module is positioned at 135° with respect to the other two modules which are positioned at 90° with respect to each other; a three-way 180° connector block 206 for mounting together three freestanding modules with two modules positioned 180° apart an the third module positioned at 90° with respect to the other two modules; and a four-way connector 208 for mounting together four freestanding modules 32 so that each module is set at 90° with respect to an adjacent module. The connector blocks include two, three and four interface sides 210 for the two-way connectors, three-way connectors and four-way connector, respectively, with each interface side having a threaded bore 212 therein. When a connector block is mounted to a plurality of freestanding modules 32 to position the same in a specific angular configuration, the interface sides 210 of the connector block are aligned with corresponding small openings 103 of adjacent, vertical frame members 36 of the freestanding modules and the cap screws 110 of the connectors 100 aligned with the small openings are set in threaded engagement with the bores 212 of the connector block. Preferably, to ensure stability of the freestanding modules 32, more than one connector block is employed and mounted to the upper and lower portions 42, 44 of the adjacent, vertical frame members 36 of the freestanding modules.

As indicated previously, the various connector blocks 200, 202, 204, 206 and 208, can be used to secure together a plurality of the freestanding modules 32 in a variety of angular configurations, with each configuration of freestanding modules forming the basic frame structure of a work station. The particular configurational requirements of a work station will dictate the number of freestanding modules 32 to be used and the type of connector block to be employed. For example, if a one-person work station is required, two freestanding modules 32 and 90-degree, two-way connector blocks 200 can be employed to form an L-shaped work station (not shown). With a worker positioned within the 90-degree arc formed by the two freestanding modules 32, the worker can be assured sufficient privacy to, for example, assemble work product.

In addition, as shown in FIGS. 1, 15, 29 and 30, if a two-worker work station is required, three-way connector blocks 204 can be used to assemble three freestanding modules 32 in a substantially Y-shaped configuration to form a Y-shaped work station 22, with the leg of the Y-shape, set at 135° with respect to the arms of the same. The Y-shape work station 22 defines two work areas and one storage area. The work areas are positioned within the 135° arcs defined by the freestanding modules 32. The storage area is defined by the modules 32 positioned at right angles to one another and thus is confined within a 90° arc.

The Y-shaped work station 22 can be contrasted with prior-art two-worker work stations (not shown) generally requiring five freestanding walls to create two work stations. The five freestanding walls are positioned in an I-shaped configuration, defining two work areas on opposite sides of the center wall. These work stations define linear, rather than radial, oriented work stations. In addition, the I configuration does not provide a storage area separate from the two work stations and confined within the interior of the I-shape. Although storage areas may be located outside of the interior of the I-shape, for example adjacent the head and tail of the same, so positioned, the storage areas may encroach upon the work area of neighboring work stations.

In contrast to prior-art two-worker work stations, the two-worker, Y-shaped work station 22 includes the above-described work areas having radial configurations, as they are defined by freestanding modules positioned at less than 180°, i.e., 135°, with respect to each other. The radial work area has been found to be superior to prior-art linear work areas because it provides a worker with greater convenience, as it orients the work station around the worker. Thus, the worker need only rotate to reach polar locations of the work area. In contrast, in a linear work station, the worker typically has to step to reach polar ends of the work area. In addition, the Y-shaped work station 22 includes the above-described storage area between the arms of the Y-shape. Because the storage area is confined within the interior of the Y-shape, it does not encroach upon work areas of neighboring work stations.

Functional components, such as work surfaces 242, shelves 244 and storage cabinets 246 can securely mount to the freestanding modules 32 of the work stations by two or more support brackets 250 including a plurality of rearwardly and downwardly depending tabs (not shown) removably received within corresponding slots 82 on vertical frame members 36 of the module(s). In order to circumvent damage to the functional components or injuries to workers which may result from inadvertent disengagement of the tabs from the vertical frame members 36, it is preferable to provide a device (not shown) capable of locking the tabs in engagement with the slots of the vertical frame members. The specific structure of the work surface support brackets 250 and the devices for locking the same to the vertical frame members are disclosed in commonly assigned U.S. Pat. No.4671481 and entitled Antidislodgement Clips.

Figure 25A:
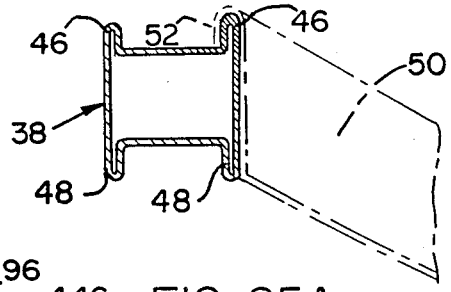
FIG. 25A is a partial sectional view taken along lines 25A—25A of FIG. 25.

Other components, such as assembly trays 50, are adapted to mount to the horizontal frame members of the freestanding modules 32 and preferably to the upper, horizontal frame members 38 thereof. Specifically, the upper lips 46 of the upper, horizontal frame member 38 function to removably suspend the assembly trays 50. As shown in FIG. 25A, the trays 50 have on the rear por-tions thereof, downwardly-depending hooks 52 engageable with the upper lips 46 of the upper, horizontal frame member 38. Since the upper lips 46 are positioned on opposite sides of the horizontal frame member, the trays 50 can be suspended on opposite sides of the module 32. In addition, since the horizontal frame member 38 spans substantially the entire width of the freestanding module 32, the trays 50 can be hung anywhere along the length of the horizontal frame member to accommodate (1) varying physical characteristics of workers, (2) functional components varying in number and geometric size and (3) the design of a variety of organizational schemes.

Figure 27:
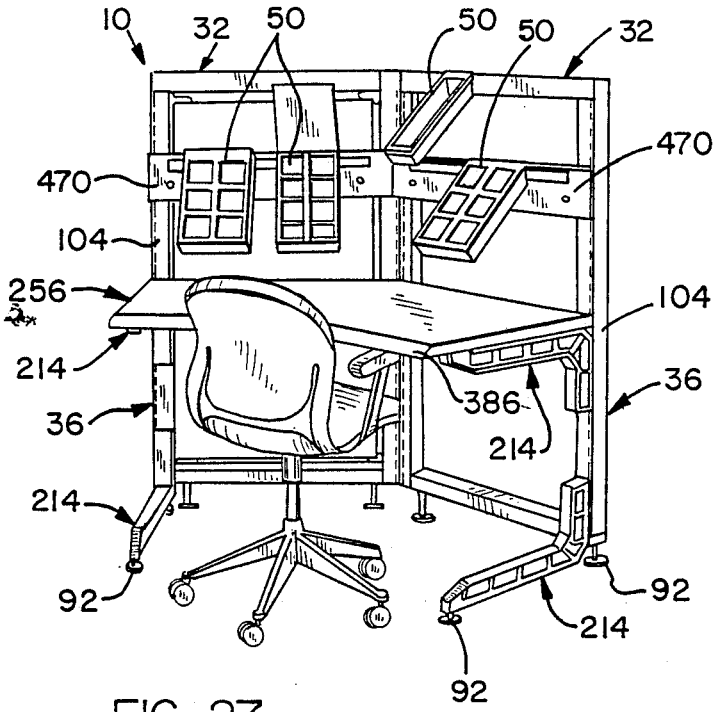
FIG. 27 is a perspective view of an assembly work station shown in FIG. 1.
Figure 30:
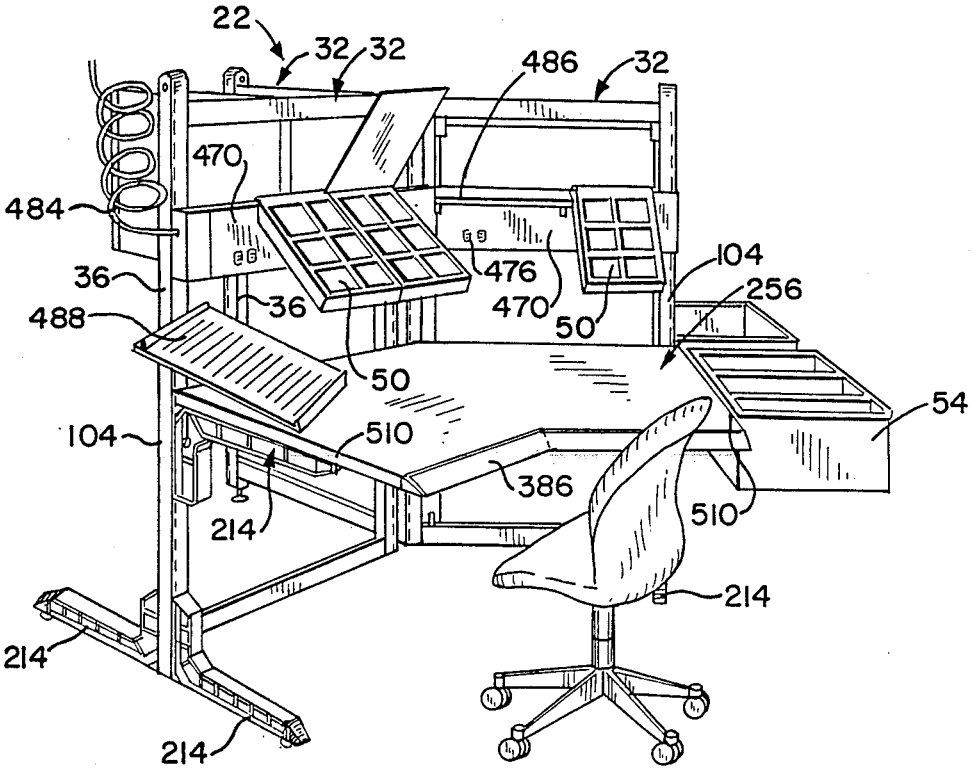
FIG. 30 is another perspective view of the Y-shaped work assembly station shown in FIG. 29.
Figure 32:
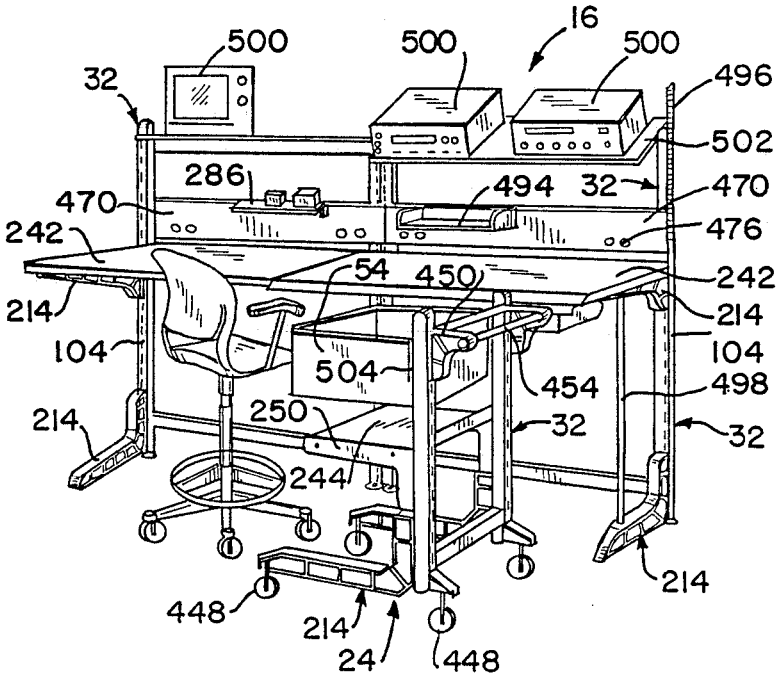
FIG. 32 is a perspective view of a test station shown in FIG. 1.

The functional components can be of various size and shape. For example, as shown in FIG. 32, the work surfaces 242 can be rectangular in shape. Because the rectangular work surfaces have a longitudinal, linear configuration, they are adapted to mount to a wall 18 formed by one or more freestanding modules 32 connected together in side-by-side juxtaposition at 180°. In addition, the work surfaces can have an angular configuration and thus be adapted to mount to freestanding modules 32 positioned at less than 180° with respect to each other. For example, as shown in FIGS. 27 and 30, the work stations 10 and 22 can include an angled work surface 256 mounted to and between freestanding modules 32 positioned at 135° with respect to each other. In this manner, the angled work surface 256 forms a continuous work surface spanning the entire radial work area defined by modules 32 of the work stations 10 and 22.

The shelves 244, like the work surfaces 242, can be rectangular in shape, have angular configurations or be substantially square in shape. For example, a square shelf (not shown) is mountable to and between a pair of freestanding modules 32 positioned at right angles to one another in the Y-shape work station 22. In this manner, the square shelf (not shown) can be mounted within the above-described storage area of the Y-shaped work station 22 to function as a means for storing articles in the work station 22.

The cabinets 246, shown in FIGS. 1 and 31, can be positioned above and below the work surfaces 242. The storage cabinets positioned above the work surfaces 242, are also mounted to the vertical frame members 36 through support brackets 250 having tabs (not shown) engageable with slots 80 of the vertical frame members 36 of the module 32. The module-mountable cabinet 246 can be of the type and construction disclosed in U.S. Pat. No. 4,615,570 and include a door 262 pivotally mounted thereto and adapted to cover the open front of the cabinet when the door is in the closed position and to rest above and in close proximity to the cabinet when in the open position.

In addition to the above-described functional components, the work stations can be equipped with numerous other components serving a variety of functions.

For example, a work surface extension 386, is illustrated in FIGS. 20–24 and 30 and is mountable to a leading edge 388 of the work surface 242. The extension 386 is an elongated, hollow, extruded member of substantially right triangular shape, in cross section, and thus includes a horizontal leg 390, a vertical leg 392 and a hypotenuse 394. The extension 386 has a length substantially equal to that of the leading edge 388 of the work surface 242. In addition, the extension 386 has two embodiments.

Figure 20:
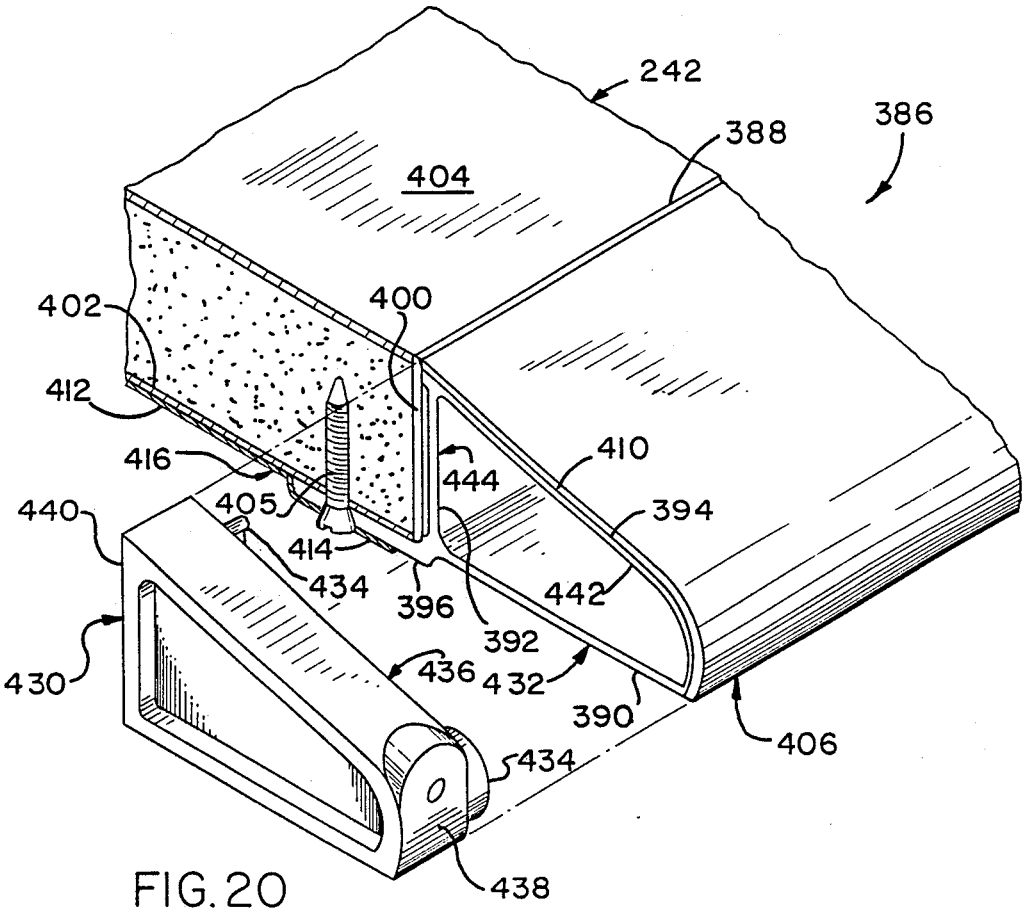
FIG. 20 is a perspective view of a work surface extension mounted to a work surface of the work environment system.
Figure 21:
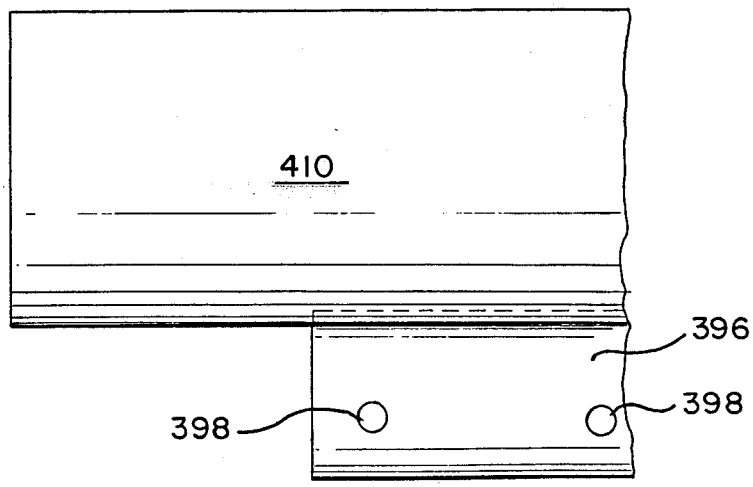
FIG. 21 is a plan view of the work surface extension illustrated in FIG. 20.

In one embodiment, as illustrated in FIGS. 20 and 21, the extension 386 comprises an elongated, horizontal flange 396 positioned slightly below and extending oppositely from the horizontal leg 390 and having a plurality of holes 398 extending therethrough. When mounted to the leading edge 388 of the work surface 242, the vertical leg 392 substantially engages a front edge 400 of the work surface, the flange 396 mattingly engages a lower surface 402 of the work surface adjacent the front edge 400 of the same, and the hypotenuse 394 is positioned substantially coextensive with and angled downwardly with respect to an upper surface 404 of the work surface. In this manner, the hypotenuse 394 can function as a convenient and comfortable armrest for a worker positioned adjacent the work surface 242. A number of screws 405 extend through the holes 398 of the flange 396 and into the work surface 242, through the lower surface 402 thereof, to securely mount the extension 386 to the leading edge 388 of the work surface.

The extension 386 also includes a grounding means 406 for discharging electric charges incident on the extension to an earth ground (not shown). The grounding means 406 comprises a conductive plastic strip 410 on and conforming to the shape of the hypotenuse 394, and conductive tape 412 connected at an interface end 414 thereof to the flange 396 of the extension and at a grounding end 416 of the tape 412 to the earth ground (not shown). In this manner, electric charges incident on the extension 386, through, for example, engagement of a worker's hand (not shown) with the hypotenuse 394, are discharged to the earth ground to thereby prevent buildup of electric charge on the extension.

Figure 22:
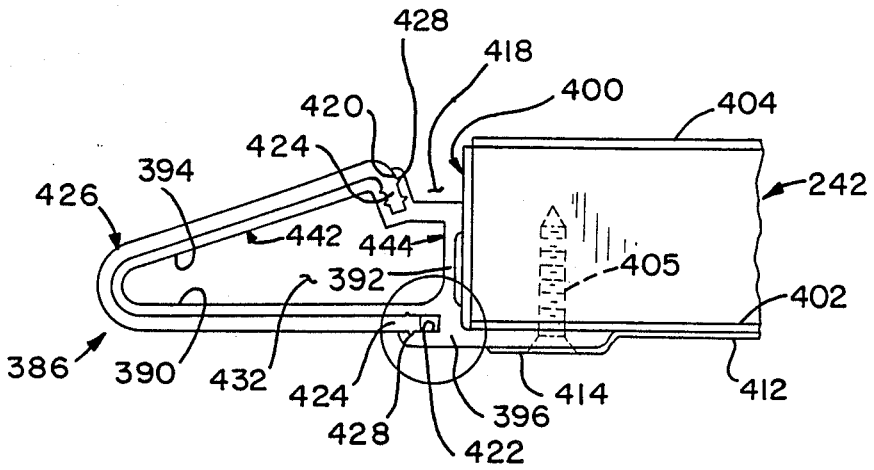
FIG. 22 is a side elevational view of an alternative embodiment of the work surface extension.
Figure 23:
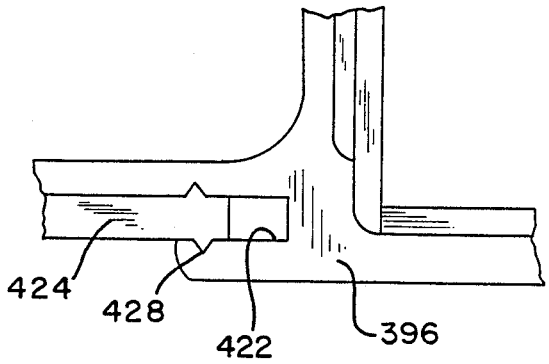
FIG. 23 is an enlarged view of a circled portion of FIG. 22.
Figure 24:
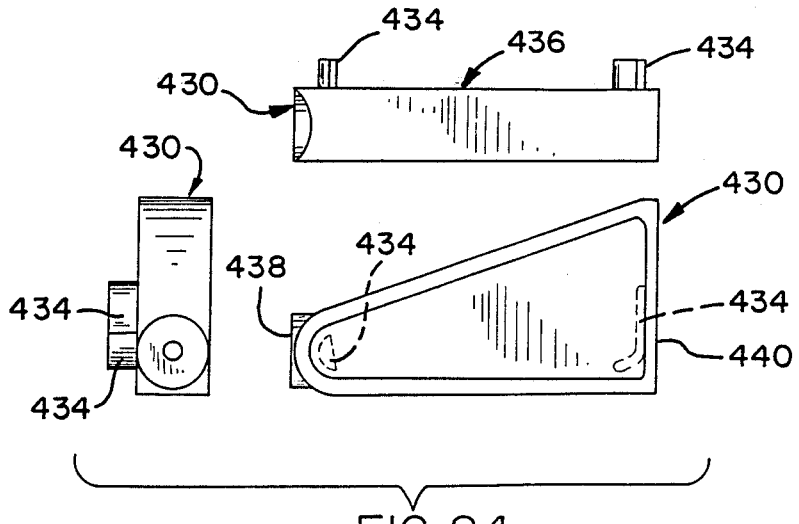
FIG. 24 illustrates plan, and side and front elevational views of an end cap of the work surface extension illustrated in FIG. 22.

The second embodiment of the worker surface extension 386, illustrated in FIGS. 22–24, is substantially similar to the above-described embodiment, with the exception that in the second embodiment, the hypotenuse 394 includes a detent notch 418 extending along the full length of the extension and which functions, in conjunction with the front edge 400 of the work surface 242, to hold pencils and other similar work accessories (not shown). The second embodiment further includes an elongated first channel 420 extending substantially the full length of and downwardly and inwardly within the hypotenuse 394 adjacent the detent notch 418, and a second channel 422 extending substantially the full length of the hypotenuse parallel to the first channel 420 and positioned inwardly between the horizontal leg 390 and the flange 396 of the extension. The first and second channels 420, 422 securely receive longitudinal edges 424 of a conductive plastic sheet 426 which wraps around and mattingly engages the hypotenuse and horizontal leg of the extension. The conductive plastic sheet 426 functions in the same fashion as the conductive plastic strip 410 on the above-described embodiment. To assist in securely holding the longitudinal edges 424 of the conductive plastic sheet 426, the channels 420, 422 are provided with a plurality of inwardly-projecting serrations 428 which resist outward movement of the longitudinal ends 424 of the conductive plastic sheet 426 by biting into the same.

Finally, as shown in FIG. 24, the extension 386 includes a pair of end caps 430 having the same triangular, cross sectional configuration as the extension and for covering open, longitudinal ends 432, shown in FIG. 22, of the extension so as to enhance the aesthetic attractiveness of the same. Each end cap 430 includes a pair of inwardly-projecting friction pads 434 formed integral with or rigidly secured to an inside wall 436 on forward and rearward ends 438, 440 of the end cap. The friction pads 434 are adapted, when the end cap 430 is mounted to the extension, to tightly engage inside walls 442, 444 of the hypotenuse and vertical leg, respectively, to securely mount the end cap to the extension in a substantially snap-fit arrangement. The specific construction of an end cap 430 for the second of the above-described two embodiments of the extension 386 is illustrated in FIG. 24.

The work environment system can further include one or more embodiments of a transport cart 446 for use in transporting work pieces to the work stations and between the work stations. Each embodiment of the transport cart can be assembled from many of the structural elements of the freestanding modules 32 as heretofore described. In this manner, the invention provides further flexibility in designing a work environment system to fit particular office, factory or commercial needs.

Figure 25:
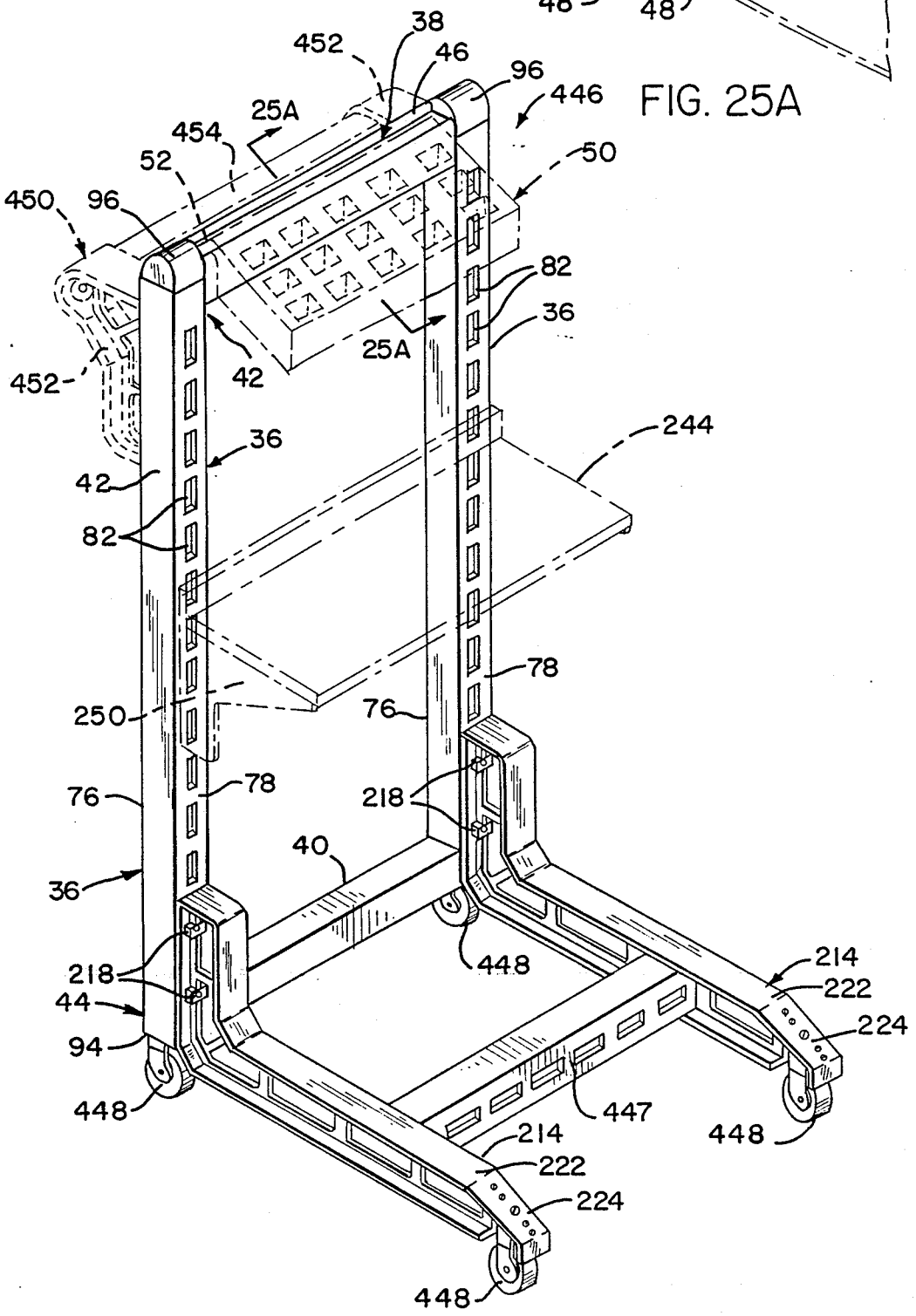
FIG. 25 is a perspective view of a transport cart of the work environment system.
Figure 26:
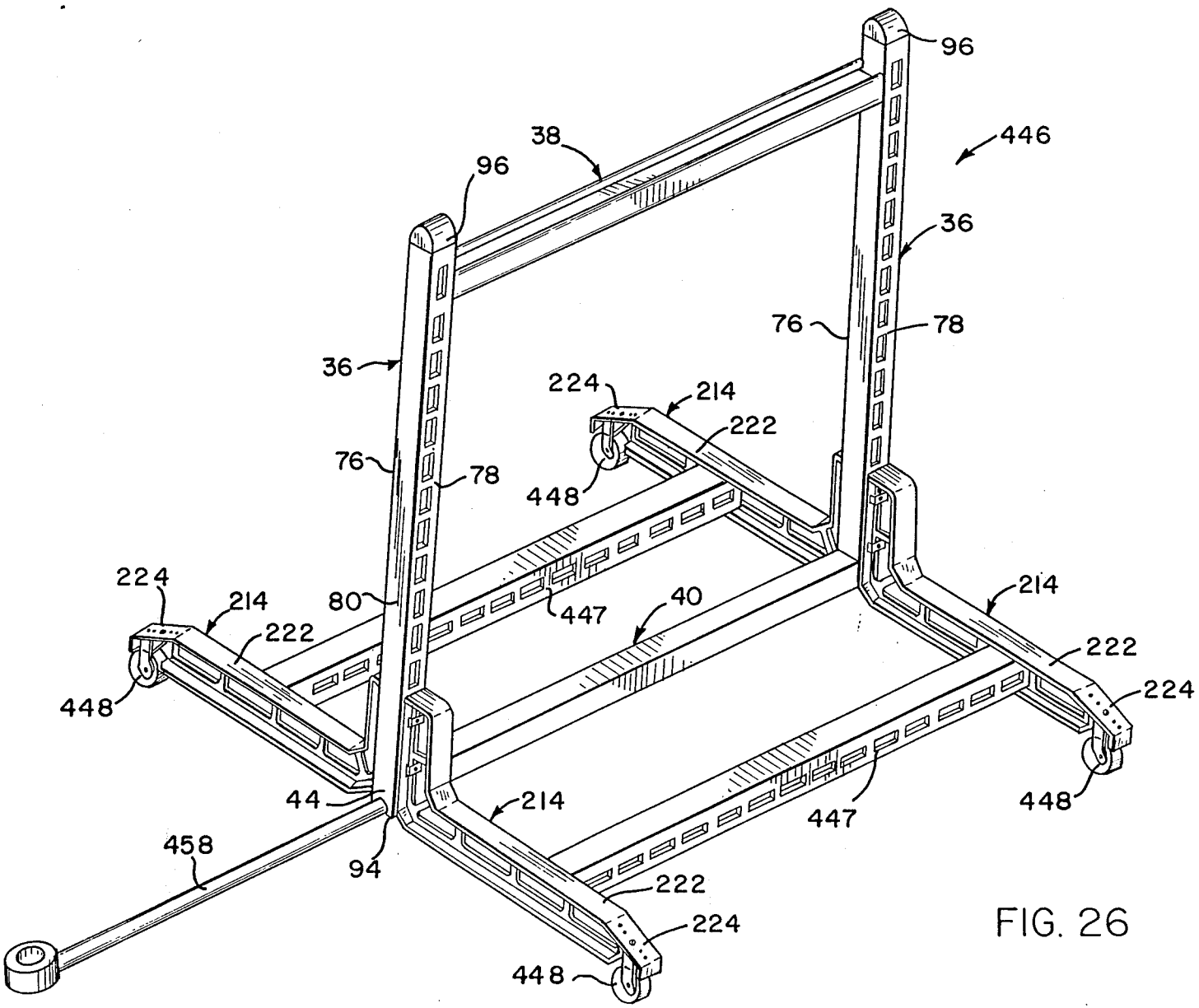
FIG. 26 is an alternative embodiment of the transport cart.

As illustrated in FIGS. 25 and 26, which illustrate two embodiments of the transport cart, the transport cart comprises the vertical frame members 36, the upper and/or lower horizontal frame members 38, 40 and the support brackets 214. The various embodiments of the transport cart 446 generally vary only with respect to the number of the support brackets 214 and the number and length of the vertical and horizontal frame members 36, 38, 40 employed in each particular embodiment. The horizontal and vertical frame members are assembled together in the same manner stated above with respect to the freestanding module to form the frame structure for the transport cart. The support brackets 214 are securely mounted to the vertical frame members by the bolts 218, of the support brackets, extending through the slots 82 of the vertical frame members and the nuts (not shown) engaging the bolts as described above.

As stated previously, the outer ends 224 of the horizontal parts 222 of the support brackets 214 include threaded bores (not shown) adapted to threadably receive the threaded shafts (not shown) of the floor glides 92. With respect to the transport cart 446, casters 448, rather than the glides 92, having threaded shafts (not shown), are adapted to threadably engage the threaded bores (not shown) of the outer ends 224 of the horizontal parts 222 of the support brackets 214.

As was also stated above with respect to the freestanding module 32, the bottom axial ends 94 of the vertical frame members 36 include the threaded bores (not shown) which threadably receive the floor glides 92. In the transport cart 446, the bores in the bottom axial ends 94 can function to threadably receive the threaded shafts (not shown) of the casters 448. The casters 448 facilitate motility of the cart for transporting work pieces between work stations.

As employed in the freestanding module 32, the horizontal frame members 38 function on the transport cart 446 to provide rigidity to the same and to support material-handling trays 50, with the downwardly-depending hooks 52 of the same engaging the lips 46 of the horizontal frame members 38. A number of horizontal frame members 38 can be secured to and between the vertical frame members 36 in stacked, spaced-apart relationship. In this manner, the transport cart can mount a number of material-handling trays 50. In addition, the vertical frame members 36 of the transport cart 446 can, as when employed in the freestanding module 32, support, for example, a shelf 244 through a pair of support brackets 250. The tabs (not shown) of the support brackets 250 engage the slots of the vertical frame members 36 of the cart 446 to mount the shelf 244 to the transport cart. In addition, more than one shelf 244 can be mounted to the vertical frame members 36 of the transport cart in stacked relationship. The shelves 244 function similar to the material-handling trays 50 to support work pieces on the transport cart as the same is wheeled between work stations.

In one embodiment of the transport cart 446, illustrated in FIG. 25, a pair of relatively long vertical frame members 36 are rigidly secured to a pair of relatively short horizontal frame members 38, 40 to form a relatively small, substantially rectangular frame for the transport cart, with the longitudinal axis of the rectangular frame positioned in a vertical plane. The cart further includes a pair of support brackets 214 mounted to the lower portions 44 of the vertical frame members 36, with both of the support brackets mounted on either the front or back walls 76, 78 of the vertical frame members. In addition, the transport cart 446 includes the casters 448 mounted to the bottom axial ends 94 of the vertical frame members 36 as well as to the outer ends 244 of the horizontal parts 222 of the support brackets 214. A material-handling tray 50 is mounted on the upper horizontal fram member 38. The cart 446 can further include a brace plate 447 rigidly secured to and between the support brackets 214 and positioned in a horizontal plane. The base plate 447 functions to add rigidity to the cart 446 and can be constructed of a vertical frame member 36.

To facilitate wheeling of the transport cart 446 between work stations, the cart is provided with a handle 450 mounted to the upper portions 42 of vertical frame members 36 on the walls thereof opposite to that to which the support brackets 214 are mounted. Thus, if the support brackets 214 are mounted to the front walls 76, the handle 450 is mounted to the rear walls 78 of the vertical frame members 36. The handle 450 comprises a pair of side brackets 452 having rearwardly-projecting hooks (not shown) engaging corresponding slots 82 of the two vertical frame members 36 at the upper portions 42 thereof, and a grip 454 securely mounted to and between the side brackets. To impart movement to the transport cart 446, the worker merely exerts a forward force on the handle in a direction perpendicular to the transverse axis of the rectangular frame structure of the cart formed by the vertical and horizontal frame members 36, 38, 40 of the same.

Figure 33:
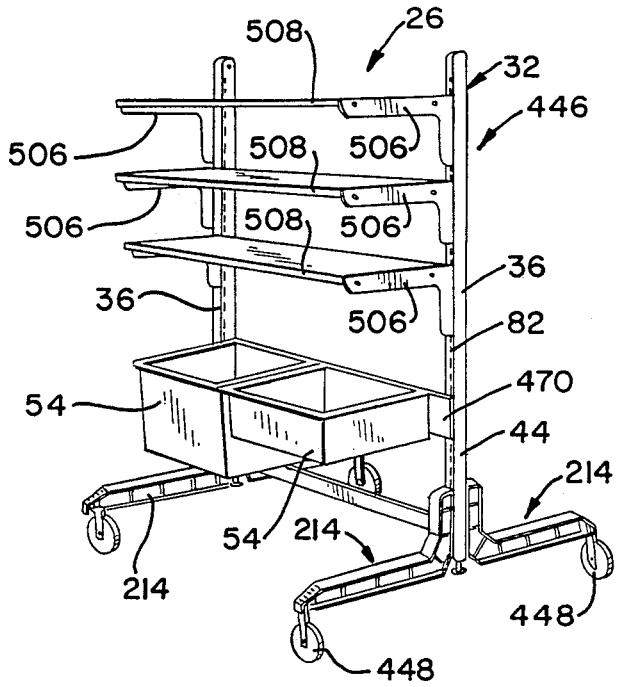
FIG. 33 is a perspective view of a transport cart shown in FIG. 1.
Figure 34:
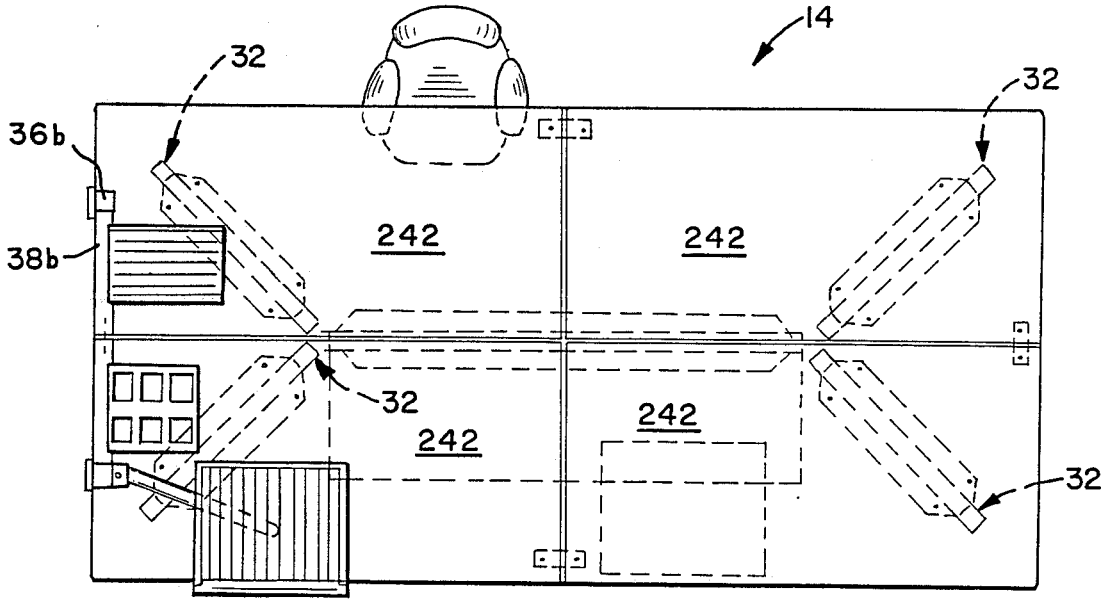
FIG. 34 is a top view of a freestanding work table shown in FIG. 1.

Illustrated in FIG. 26 is a second embodiment of the transport cart 446 which comprises a pair of vertical and horizontal frame members 36, 38, 40 secured together so as to form a relatively large, substantially rectangular frame of the transport cart, with the longitudinal axis of the frame positioned in a horizontal plane. A pair of support brackets 214 is mounted to the front and rear walls 76, 78 of each vertical frame member 36. In this manner, the cart includes a total of four support brackets 214, compared to the two support brackets 214 of the above-described embodiment of the transport cart. In addition, a caster 448 is mounted to the outer end 224 of the horizontal part 222 of each support bracket, in the manner described above. In contrast to the embodiment illustrated in FIG. 25, the bottom axial ends 94 of the vertical frame members 36 of the embodiment illustrated in FIG. 26 do not mount casters. However, as shown in FIG. 33 and like the embodiment of the transport cart 446 of FIG. 25, shelves 224, trays 50 and totes 54 can be mounted to the horizontal and vertical frame members to support work pieces (not shown) to be transported between work stations in the embodiment of FIG. 26. A pull rod 458 is pivotally mounted for vertical movement to an outside wall 80 of one of the two vertical frame members 36, at a lower portion 44 thereof, and functions like the handle 450 in the above-described embodiment to facilitate movement of the cart between the work stations. By pulling the rod in a forward direction along the longitudinal axis of the rectangular frame of the cart, the cart can be wheeled in a forward direction. Unlike the handle 450, the pull rod 458 can be removably "hitched"to a vehicle, such as a golf carttype vehicle, to conveniently haul work pieces between work stations separated by relatively large distances as well as be manually moved by a worker pulling the rod.

Referring to FIG. 1, and in particular to FIG. 27, there is shown a 135° assembly work station 10. This work station comprises two rectangular frame modules 32 joined together by 135° two-way connectors 202, illustrated in FIG. 14. Each module 32 includes a support bracket 214 mounted to a vertical frame member 36 of the module and a number of floor glides 92 mounted to the bottom axial ends 94 of the vertical frame members and the outer ends 224 of the support bracket 214. The support brackets 214 stabilize the connected frame modules 32. The support brackets 214 are also mounted at the central portions 104 of the vertical frame members 36 in an inverted fashion to provide support for an angled work surface 256. The work surface extensions 386 are provided on the outer ends of the work surface 256. A support rail 470 is mounted to the vertical frame members 36 of the frame modules 32 through downwardly-depending hooks (not shown) which engage the slots 82 in the vertical frame members 36 in the conventional manner. The support rails 470 are indented at the upper portions thereof so as to have a configuration substantially similar to the upper lips 46 of the upper horizontal frame member 38. In this manner, the rails 470 are adapted to support thereon in a slanted fashion assembly trays 50 having the hooks 52 which engage the lips of the support rail 470.

Figure 28:
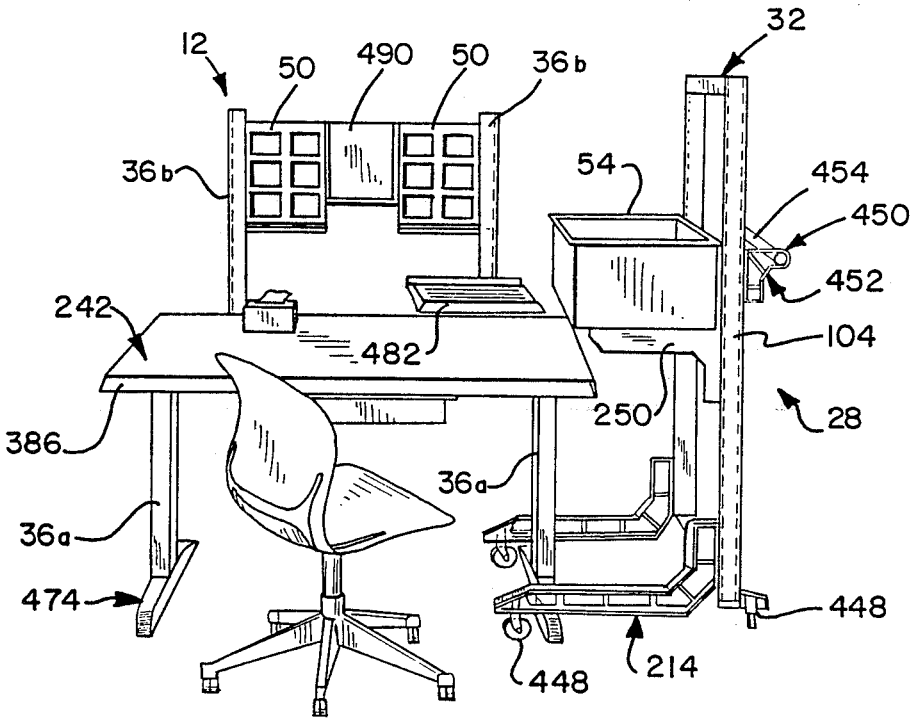
FIG. 28 is a front perspective view of a table work station and a transport cart shown in FIG. 1.

Referring to FIG. 28, there is shown the table work station 12 which is formed by vertical frame members **36*a* and a rectangular work surface 242. Bracket feet 474 are secured to the bottom of the vertical frame members 36*a* in a fashion similar to the manner in which the support brackets 214 are secured to the vertical frame members 36 of the freestanding modules 32. The vertical frame members 36*a* can be secured to the work surface 242 through table brackets (not shown) such as described below with reference to FIGS. 36 and 37. A pair of vertical frame members 36*b* are secured to the rectangular work surface 242 through bracket clamps 472. See also FIG. 35. The frame members 36*b* support horizontal rails (not shown) mounting the trays 50 and a book shelf 490 in the same fashion as the trays 50 are mounted to the support rail 470 in FIGS. 25A and 27. A tool support surface 482 can be movably mounted to one of the vertical frame members 36*b* through an articulating arm 480. See FIGS. 29 and 31**.

One embodiment of the transport cart 446 is positionable adjacent to the rectangular work surface 242 to assist in work operations at the table and to move completed work to another work station. The cart 446 comprises the rectangular frame module 32 having positioned at the bottom portion thereof support brackets 214 to which are attached the casters 448. The casters 448 are also mounted directly to the vertical frame members 36 as described above with respect to FIG. 25. The support brackets 250 are mounted at central portions 104 of the vertical frame members 36 to support a shelf 244 which in turn supports a tote 54. A pair of handle side brackets 452 are also mounted on a central portion 104 of the vertical frame members 36 and in turn mount a handle grip 454 for ease in moving the cart 446 from work station to work station.

Figure 29:
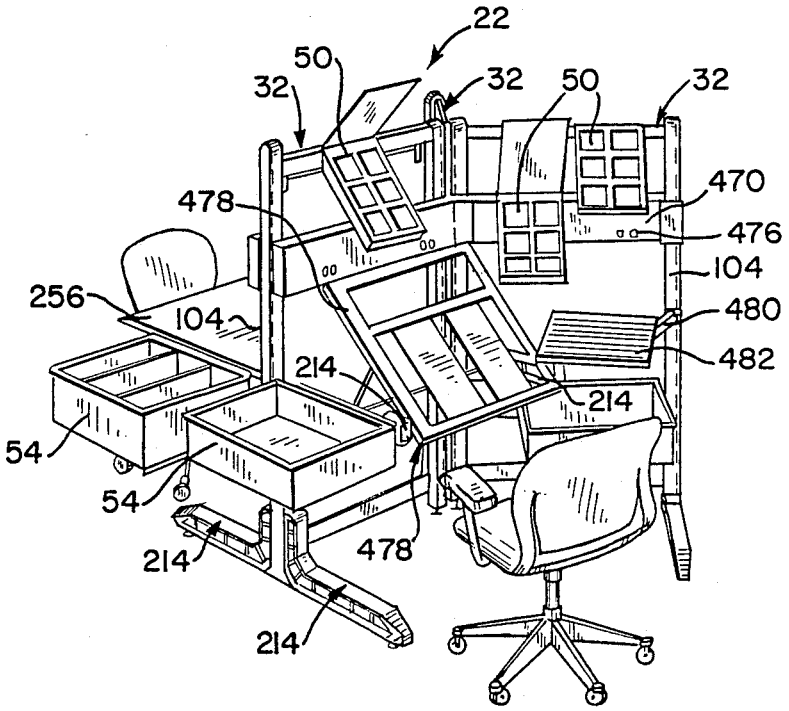
FIG. 29 is a perspective view of a Y-shaped work assembly station shown in FIG. 1.

Referring now to FIG. 29, there is shown a Y-shaped assembly work station 22 which is also illustrated in FIG. 1. The Y-station 22 comprises three rectangular frame modules 32 joined together at abutting edges through 135° three-way connector blocks 204 illustrated in FIG. 15. The connector blocks 204 are so configured as to provide included angles of 135° , 135° and 90° between the three modules 32. Thus, the Y-station 22 forms two 135° work stations similar to the work stations 10 and a 90° storage area where files, shelves and cabinets can be positioned. The Y-station 22 can further include the support rails 470 which are secured to the vertical frame members 36 of the modules 32 within the two 135° work stations. Electrical outlets 476 are provided in the support rails 470. Assembly trays 50 are mounted on the support rails 470 as well as on the upper horizontal frame members 38 of the frame modules 32. The support brackets 214 are mounted to the central portions 104 of the vertical frame members 36 to support the totes 54 through bracket plates (not shown) on the support brackets 214 and to also support a rack 478 for assembly operations. An articulating arm 480 is mounted to the central portion 104 of a vertical frame member 36 through hooks (not shown) which engage the slots 82 in the vertical frame member 36. A tool support surface 482 is adjustably mounted to the end of the articulating arm 480 to provide a surface on which the worker may place various tools and equipment used in the assembly operation.

FIG. 30 illustrates a Y-shaped assembly work station similar to that illustrated in FIG. 29. The support brackets 214 are provided at the bottom of the vertical frame members 36 for stability of the modules 32 as well as to the central portions 104 of the vertical frame members 36 to support the work surface 256. The totes 54 having depending flanges (not shown) which engage bracket plates (not shown) on the support brackets 214 to support the totes at the edge of the work surface 256. Electrical energy can be supplied through an electrical-energy supply line 484 to the support rail 470 to supply power to the electrical outlets 476, The articulating arm (not shown in FIG. 30) is mounted to the central portion 104 of a vertical frame member 36 and supports a reader stand 488 for placement of instruction manuals and drawings for use by the worker at the work station. A minishelf 486 is also shown mounted to the support rail 470. To this end, the minishelf has a depending flange (not shown) which engages the lip (not shown) of the rail 470.

Figure 31:
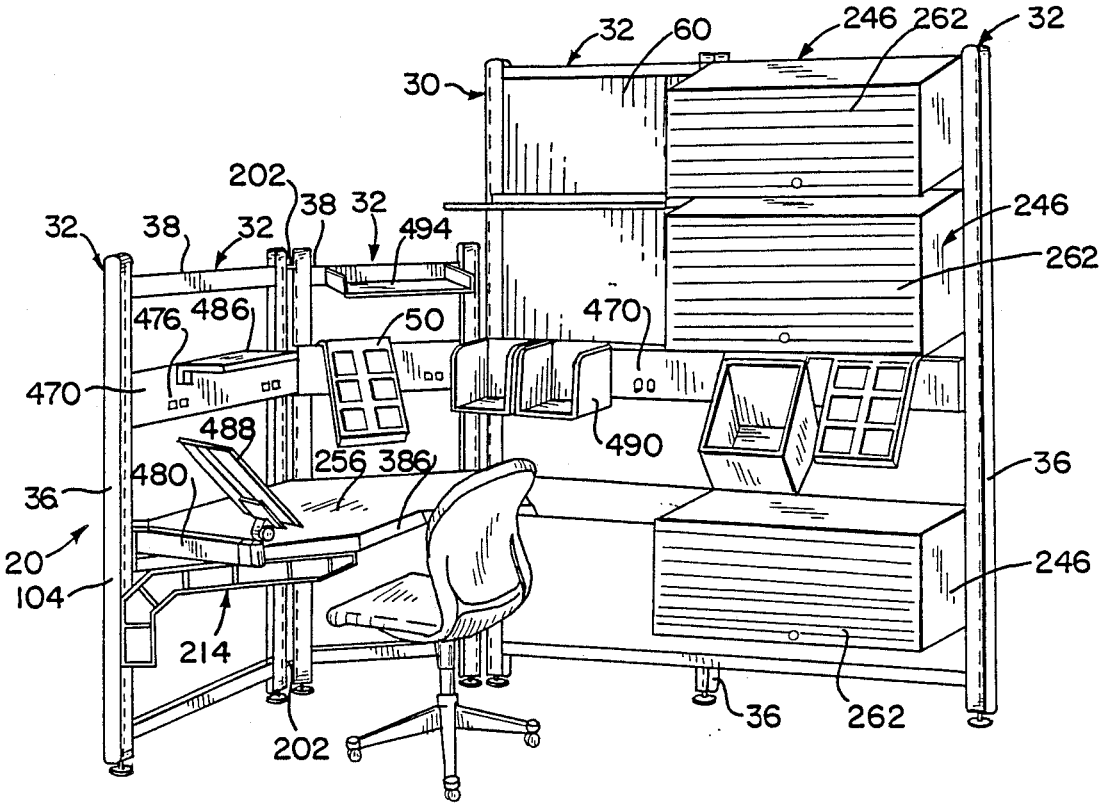
FIG. 31 is a perspective view of a desk station shown in FIG. 1.

Referring now to FIG. 31, there is shown a desk station 20 substantially similar to the desk station 20 illustrated in FIG. 1. The freestanding wall 18 is formed from a pair of rectangular frame modules 32 secured together in end-to-end juxtaposition. The desk station 20 is formed by a freestanding wall 18 formed of a pair of rectangular frame members 32 connected together by a 135° two-way connectors 202 of the type illustrated in FIG. 14. The angled work surface 256 is mounted to the frame modules 32 through support brackets 214. The support rails 470, having the electrical outlets 476, are also mounted to the vertical frame members 36 of the frame modules 32. The minishelves 486 and the assembly trays 50 are shown mounted to the support rail 470 as described above in connection with FIGS. 28–30. A paper tray 494 is shown mounted to an upper horizontal frame member 38 of the frame module 32 through a hook (not shown) on the tray and engaging the upper lip 46 of the frame member 38. The articulating arm 480 is mounted to a central portion 104 of a vertical frame member 36 and mounts a reader stand 488. The articulating arm 480 is rotatably mounted to the vertical frame member 36 about a vertical axis of rotation. Further, the reader stand 488 is swivelably mounted to the articulating arm 480 to permit different orientations of the reader stand with respect to the articulating arm 480.

The freestanding wall 18 is formed from two rigid frame modules 32 joined rigidly together through the connectors 100 illustrated in FIGS. 4–12. Further, the freestanding wall 18 is provided with the panels 60 mounted between horizontal upper and lower frame members 38, 40 of the modules 32 of the wall 18. The cabinets 246 are mounted to the vertical frame members 36 in the manner stated above. A plurality of book shelves 490 are also mounted on the frame modules 32 through the support rails 470. A number of the assembly trays 50 can also be mounted on the support rails 470.

Referring now to FIG. 32, there is shown the test station 16 which is also illustrated in FIG. 1. The test station 16 comprises a wall 18 formed from a pair of rectangular frame modules 32 connected together in end-to-end juxtaposition by the connectors 100. The support brackets 214 are mounted to the lower portions of the vertical frame members 36 for stabilization of the test station 16. A pair of rectangular work surfaces 242 are mounted to the frame modules 32 through the support brackets 214 mounted at the central portions 104 of the vertical frame members 36. Support rails 470 are mounted to the vertical frame members 36 of the frame modules 32 above the work surfaces 242 and support the paper trays 494 and a minishelf 486. An electrical energy supply conduit 496 is connected to the support rails 470 to supply electrical energy to the electrical outlets 476 mounted in the support rails 470. A brace 498 is mounted to and between the support bracket 214, at the lower portion of the vertical frame member 36, and a support bracket 214, at the central portion 104 of the frame member 36, to prevent the work surface 242 from sagging. A slanted shelf 502 is mounted to an upper horizontal frame member 38 to support various pieces of test equipment 500. A horizontal shelf can also be mounted to the upper horizontal frame member 38 for supporting test equipment 500 and the like.

Also shown in FIG. 32 is an embodiment of the transport cart 446. As stated above, the cart 446 is formed by a rectangular frame module 32. A rail 504, similar to the support rail 470, is mounted to the vertical frame members 36 of the cart 24 and supports the tote 54. The handle grip 454 mounted to the cart 446 facilitates moving the cart from work station to work station. The support brackets 250 are also mounted to the vertical frame members 36 of the cart 24 to support an intermediate shelf 244 on the cart.

FIG. 33 shows an embodiment of a transport cart 446 similar to the embodiment illustrated in FIG. 26. The transport cart 446 is formed from a rectangular frame module 32 having a pair of vertical frame members 36 to which are mounted four support brackets 214 at bottom portions 44 of the frame members 36. The casters 448 are mounted to the support brackets 214 as described above. The rail 470 is mounted to the portions of the vertical frame members 36 and supports the totes 54. Brackets 506 are mounted to upper and central portions 42, 104 of the vertical frame members 36 through conventional hooks on the brackets which engage the slots 82 in the frame members 36. The shelves 244 are supported by the brackets 506 to carry parts and work in process (not shown). The transport cart 446 can be moved from work station to work station to take work-in-process (not shown), to pick up totes and deliver totes, and to deliver trays and parts (not shown) to various work stations Referring now to FIGS. 34–37, there is shown the freestanding work table 14 also illustrated in FIG. 1. The work station 14 comprises four rectangular work surfaces 242 which are supported by five rigid rectangular frame modules 32. A central frame module 32 is connected at each end to two angularly spaced frame modules 32 through 135° three-way connector blocks 204.

Figure 35:
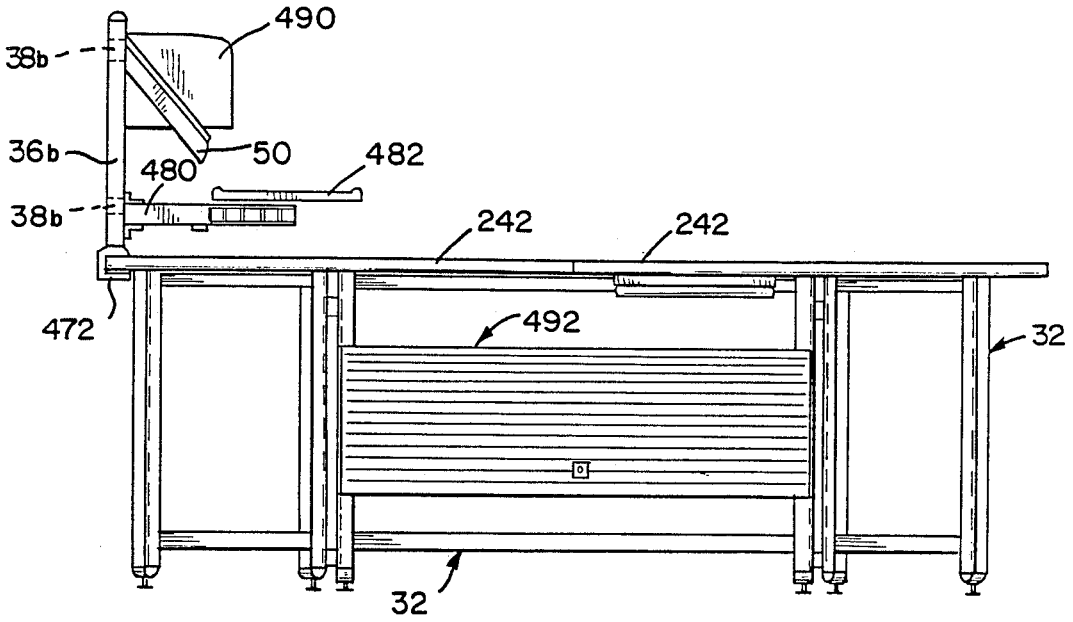
FIG. 35 is a front elevational view of the freestanding work table shown in FIG. 34.
Figure 36:
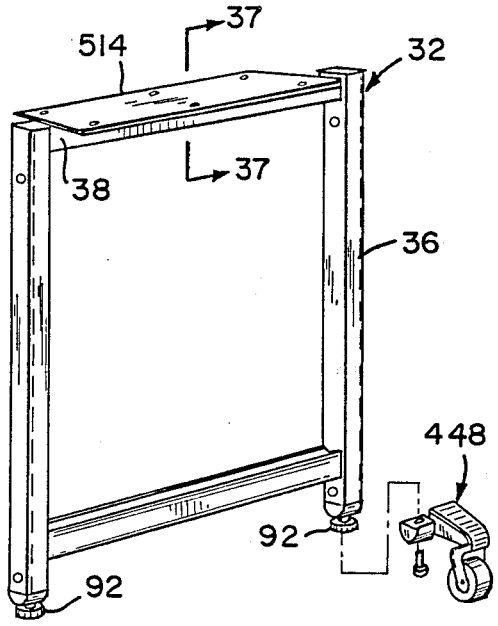
FIG. 36 is a perspective view of a module used in constructing the freestanding work tables shown in FIGS. 34 and 35.
Figure 37:
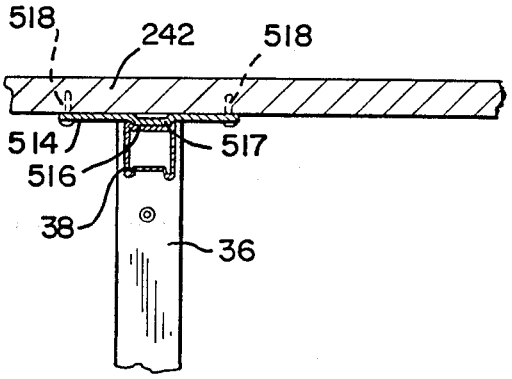
FIG. 37 is a partial sectional view taken along lines 37—37 of FIG. 36 and showing the positioning of a work surface on the module.

The frame modules 32 illustrated in FIG. 34–37 have mounted to the upper horizontal frame members thereof flat table brackets 514 having positioning projections 516 thereon. As illustrated in FIG. 37, the positioning projection 516 fits within indentation 517 formed by the upper lips 46 of the upper horizontal frame member 38 and is welded thereto. Screws 518 extend through holes in the table brackets 514 to secure the work surfaces 512 to the rectangular frame modules 32. As illustrated in FIG. 36, the floor glides 92 or the casters 448 can be secured to the lower portion 44 of the vertical frame members 36 in the manner described above. Thus, the tables can be either stationary with floor glides 92 or can be movable with casters 448.

As illustrated in FIG. 35, the vertical frame members **36*b* are secured to ends of the work surfaces 242 by clamps 472 and support two horizontal frame members 38*b*. The articulating arm 480 can be mounted to one of the vertical frame members 36*b* for rotational movement about a vertical axis at the joint between the two parts. Further, the tool surface 482 can be mounted to the articulating arm 480. The tray 50 and the book shelf 490 can be mounted to the upper horizontal frame member 36*b*** in the manner described above.

The invention provides for a robust and very functional factory work space environment in which common elements are utilized in various different combinations and permutations to create work spaces which assist in the functional requirement of the area. The components can be shipped in a knock-down configuration and quickly assembled on the site for further economy. Still further, the work stations and various components can be easily and quickly assembled and disassembled as needs arise and change to maximize flexibility of the system. The individual components are strong, yet economical to manufacture and assemble. The frame components are essentially identical. Thus, there is less inventory required and greater flexibility in the utilization of basic building blocks for the system.

Reasonable variation and modification are possible within the scope of the foregoing disclosure and drawings without departing from the spirit of the invention.

The embodiments of the invention in which an exclusive property or privilege is claimed are defined as follows:

1. A modular factory work space management system comprising freestanding frame modules and freestanding tables, all of which are selectively arranged around a room in a preplanned configuration;

mobile carts movable about said room between said frame modules and said freestanding tables;

said frame modules and said tables being adapted to mount horizontal work surfaces;

said mobile carts, said freestanding tables and said freestanding frame modules having in common interchangeable structural components comprising;

rigid open rectangular frames having vertical frame members and horizontal frame members, each of said vertical frame members being tubular and rectangular in cross-section and having a series of slots for hanging function components thereon;

said horizontal frame members having ends rigidly joined to said vertical frame members, said horizontal frame members further being substantially H-shaped in cross-section and defining upper and lower vertical lips extending longitudinally of said horizontal frame members for retaining functional components above and below said horizontal frame members.

2. A modular factory work space management system according to claim 1 and further comprising cabinets having a rear surface with depending hooks mounted thereon for engaging said vertical slots in said vertical frame members, said cabinets mounted to some of said frames through said depending hooks and said vertical slots.

3. A modular factory work space management system according to claim 1 and further comprising opentop trays formed by side walls and a bottom wall, a depending hook portion extending from the top of one side wall and in spaced relationship thereto, said depending hook portion adapted to extend downwardly behind one of said horizontal frame-member lips when said one side wall abuts a front face of said one horizontal frame member to thereby support said trays from said horizontal frame member; and said trays being supported on at least some of said horizontal frame members through said depending hook portions and said horizontal frame lips.

4. A modular factory work space management system according to claim 1 and further comprising panels having a height and width adapted to fit in an open space between said horizontal and vertical frame members and having a thickness adapted to fit between the lips of said horizontal frame member;

said panels being positioned within said open spaces of at least some of said frames with a bottom surface of each of said panels resting on a lower said horizontal frame member between upstanding ones of said lips and an upper surface thereof being positioned between downward ones of said lips on an upper said horizontal frame member;

whereby said panels are retained in said open space of said frame by said upstanding lips on said lower horizontal frame member and by said downward lips on said upper horizontal frame member.

5. A modular factory work space management system to claim 1 wherein said horizontal frame members are joined to said vertical frame members by welding.

6. A modular factory work space management system according to claim 1 and further comprising brackets secured to at least some of said horizontal frame members and work surfaces resting on said brackets; and means securing said brackets to said work surfaces to form said tables.

7. A modular factory work space management system according to claim 1 further comprising support brackets having a vertical edge and a horizontal edge, hooks on said vertical edge adapted to engage said vertical slots in said vertical frame members; first pairs of said support brackets being mounted on at least some of said vertical frame members at or above a central portion thereof in horizontally spaced, aligned positions; and shelves and work surfaces mounted to the horizontal edges of at least some of said support brackets.

8. A modular factory work space management system according to claim 7 wherein second pairs of said support brackets are positioned on a bottom portion of said vertical frame members with said horizontal edge facing downwardly, whereby said second pairs of support brackets form stabilizing feet for said frame.

9. A modular factory work space management system according to claim 8 and further comprising wheels mounted to the horizontal edges of certain of said second pairs of support brackets to provide mobility to certain of said frames.

10. A modular factory work space management system according to claim 1 wherein said horizontal frame members are joined to said vertical frame members through a bolt-and-nut connection.

11. A modular factory work space management system according to claim 10 wherein said bolt-and-nut connection includes a plate in the end of said horizontal frame members, said plate having a threaded opening forming a nut, and said bolt extends through one wall of said vertical frame member and threads into said threaded opening in said plate.

12. A modular factory work space management system according to claim 10 and further comprising interengaging means to prevent lateral and rotational movement of said horizontal frame member with respect to said vertical frame member.

13. A modular factory work space management system according to claim 12 wherein said interengaging means comprises projections on the ends of said horizontal frame member and openings in said one wall of said vertical frame members in registry with said projections.

14. A modular factory work space management system according to claim 1 and further comprising frame connector means for joining said rectangular frames together at vertical side edges thereof; and at least some of said rectangular frames are positioned with vertical side edges adjacent each other and are rigidly joined together through said frame connector means.

15. A modular factory work space management system according to claim 14 wherein some of said frames are joined together at 180° with respect to each other.

16. A modular factory work space management system according to claim 14 wherein at least some of said frames are joined together at 90° with respect to each other.

17. A modular factory work space management system according to claim 14 wherein at least some of said frames are joined together at 135° with respect to each other.

18. A modular factory work space management system according to claim 14 wherein three of said frames are joined together with a common connection and extend radially therefrom, the angles between said frames being 135°, 135° and 90°.

19. A modular factory work space management system according to claim 14 wherein portions of said vertical frame members extend below a lower one of said horizontal frame members in said rectangular frame and said frame connector means are positioned in said portions below said lowermost horizontal frame member.

20. A modular factory work space management system according to claim 14 wherein portions of the vertical frame members extend above an upper one of the horizontal frame members and the frame connector means are positioned in said portions above said upper one of said horizontal frame members.

21. A modular work space management system according to claim 20 wherein portions of said vertical frame members extend below a lower one of said horizontal frame members in said rectangular frame and said frame connector means are positioned in said portions below said lowermost horizontal member.

22. In a work space management system wherein rigid open rectangular frames having vertical frame members and horizontal frame members are joined together at vertical frame members to form work stations, frame connector means for rigidly connecting together the rigid open rectangular frames at the vertical frame members, the improvement in the frame connector means comprising:

openings in opposite side faces of adjacent first and second vertical faces members, the openings being in registry with each other;

first and second draw blocks mounted respectively in the first and second frame members in registry with the openings in the side faces thereof, horizontal bores in the draw blocks in registry with the openings in the side faces, at least said bore in said first draw block being threaded;

a bolt extending through said draw-block bores in said adjacent first and second vertical frame members, said bolt having a threaded end which is adapted to threadably engage the threaded bore in the first draw block while being retained by the second draw block to draw said adjacent vertical frame members together as said bolt is tightened.

23. A work space management system according to claim 22 wherein the bolt has an unthreaded portion and a head on another end, the head is adapted to abut an inner portion of the second draw block, and the unthreaded portion extends through the bore in the second draw block when the bolt head abuts the inner end of the second draw block, whereby the bolt draws the two draw blocks toward each other as the bolt is tightened.

24. A work space management system according to claim 23 wherein the bore in the second draw block is also threaded, the bolt has a length substantially the lateral width of the vertical frame member, the bolt threaded end is adapted to thread into the second draw block threaded bore, whereby the bolt can be stored wholly within the second vertical frame member when the vertical frame members are unconnected to each other.

25. A work space management system according to claim 31 and further comprising draw-block holder means to releasably retain the draw blocks in the vertical frame members.

26. A work space management system according to claim 25 wherein the draw-block holder means comprises a tubular body which extends through one said opening in an inner wall of the vertical frame member and the draw block is releasably retained within the tubular body.

27. A work space management system according to claim 26 wherein portions of the vertical frame members extend above an upper portion of the horizontal frame members and the frame connector means are positioned in the portions above the horizontal frame member.

28. A work space management system according to claim 27 wherein portions of the vertical frame members extend below a lower one of the horizontal frame members in the rectangular frame and the frame connector means are positioned in the portions below the lowermost horizontal, frame member.

29. A modular factory work space management system comprising freestanding frame modules, freestanding tables and mobile carts, said modules and said tables being selectively arranged around a room in a preplanned configuration and adapted to mount horizontal work surfaces, said movable carts being movable about said room between said frame modules and said tables;

said mobile carts, said freestanding tables and said freestanding frame modules having in common interchangeable structural components comprising rigid open rectangular frames having vertical frame members and horizontal frame members, each of said vertical frame members being tubular and rectangular in cross-section and having a series of slots for hanging functional components thereon, said horizontal frame members having ends rigidly joined to said vertical frame members, said horizontal frame members further being substantially H-shaped in cross-section and defining upper and lower vertical lips extending longitudinally of said horizontal frame members for retaining functional components above and below said horizontal frame members;

said work space management system further comprising frame connector means for joining said rectangular frames together at vertical side edges thereof, said frame connector means comprising:

openings in opposite side faces of adjacent first and second vertical frame members, said openings being in registry with each other;

first and second draw blocks mounted respectively in said first and second frame members in registry with said openings, horizontal bores in said draw blocks in registry with said openings, at least said bore in said first draw block being threaded; and a bolt extending through said draw block bores in said adjacent first and second vertical frame members, said bolt having a threaded end which is adapted to threadably engage said threaded bore in said first draw block while being retained by said second draw block to draw said adjacent vertical frame members together as said bolt is tightened.

30. A modular factory work space management system according to claim 29 wherein said bolt has an unthreaded portion and a head on another end, said head is adapted to abut an inner portion of said second draw block, and said unthreaded portion extends through said bore in said second draw block when said bolt head abuts said inner end of said second draw block, whereby said bolt draws said two draw blocks toward each other as said bolt is tightened.

31. A modular factory work space management system according to claim 30 wherein said bore in said second draw block is also threaded, said bolt has a length substantially the lateral width of said vertical frame member, said bolt threaded end is adapted to thread into said second draw block threaded bore, whereby said bolt can be stored wholly within said second vertical frame member when said vertical frame members are unconnected to each other.

32. A modular factory work space management system according to claim 31 and further comprising draw-block holder means to releasably retain said draw blocks in said vertical frame members.

33. A modular factory work space management system according to claim 32 wherein said draw-block holder means comprises a tubular body which extends through one said opening in an inner wall of said vertical frame member and said draw block is releasably retained within said tubular body.

34. A modular factory work space management system according to claim 33 wherein portions of said vertical frame members extend above an upper one of said horizontal frame members and said frame connector means are positioned in said portions above said horizontal frame member.

35. A modular factory work space management system according to claim 34 wherein portions of said vertical frame members extend below a lower one of said horizontal frame members in said rectangular frame and said frame connector means are positioned in said portions below said lowermost horizontal frame member.

* * * * *